US007059745B2

(12) United States Patent
Gordin et al.

(10) Patent No.: US 7,059,745 B2
(45) Date of Patent: Jun. 13, 2006

(54) LIGHTING FIXTURE WITH QUICK-DISCONNECT LIGHT SOURCE MOUNT

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 494 days.

(21) Appl. No.: 10/072,703

(22) Filed: Feb. 7, 2002

(65) Prior Publication Data

US 2003/0147240 A1 Aug. 7, 2003

(51) Int. Cl.
*H01R 33/00* (2006.01)

(52) U.S. Cl. ..... 362/226; 362/263; 362/368; 439/375; 439/558; 439/699.2

(58) Field of Classification Search ..... 362/226, 362/257, 263, 296, 297, 298, 300, 310, 311, 362/362, 368; 439/374, 375, 544, 552, 557, 439/558, 625, 660, 699.1, 699.2, 702, 753
See application file for complete search history.

(56) References Cited

U.S. PATENT DOCUMENTS

| | | | | |
|---|---|---|---|---|
| 1,137,773 A | * | 5/1915 | Marsden | 362/226 |
| 1,535,985 A | | 4/1925 | Clark | |
| 1,961,719 A | | 6/1934 | Uyterhoeven | |
| 1,991,584 A | | 2/1935 | Strauss | |
| 2,904,710 A | | 9/1959 | Beeninga | |
| 3,099,403 A | | 7/1963 | Starwick | |
| 3,281,620 A | | 10/1966 | Miller | |
| 3,511,985 A | | 5/1970 | Muscovitch | |
| 3,586,851 A | | 6/1971 | Rudolph | |
| 3,609,337 A | | 9/1971 | Adra | |
| 3,686,495 A | | 8/1972 | Medley | |
| 3,832,540 A | * | 8/1974 | Roth | 362/217 |

(Continued)

FOREIGN PATENT DOCUMENTS

| | | |
|---|---|---|
| DE | 3536583 A1 | 4/1986 |
| EP | 0 389 408 A1 | 9/1990 |
| EP | 1 037 245 A2 | 9/2002 |
| GB | 1562929 | 3/1980 |
| VN | 1-0004602 | 10/2004 |
| WO | WO 94/15143 | 7/1994 |
| WO | WO 02/063210 A2 | 8/2002 |

OTHER PUBLICATIONS

OSRAM–Sylvania, METALARC Briteline–Product Information Bulletin, May 1999, complete disclosure.*

(Continued)

*Primary Examiner*—John Anthony Ward
*Assistant Examiner*—Ismael Negron
(74) *Attorney, Agent, or Firm*—McKee, Voorhees & Sease, P.L.C.

(57) ABSTRACT

A luminaire assembly (10) using a double-ended, unshielded high intensity discharge (HID) light source (100). In one aspect, the assembly (10) includes a light source mount (22) adapted to manually, without tools, mount and remove the HID light source (100). The light source mount (22) can optionally include structure (106L and R, 134L and R) to automatically position the light source (100) in a desired orientation. In another aspect, the assembly (10) includes a connection (104L and R, 304L and R, 306L and R) adapted to manually, without tools, connect the light source (100) to electrical power, the connection (104L and R, 304L and R, 306L and R) can be configured to have no electrically conducting surfaces directly exposed or accessible to human fingers and can be configured to be positioned relatively away from the light source (100). In another aspect, the assembly (10) can include an ignitor circuit for the light source (100) farther away from a ballast circuit for the light source (100) but closer to the light source (100). The ignitor circuit can be in a housing (16) that is mountable to the assembly (10).

77 Claims, 24 Drawing Sheets

U.S. PATENT DOCUMENTS

| | | | | | |
|---|---|---|---|---|---|
| 4,087,682 | A | | 5/1978 | Kolodziej | |
| 4,164,783 | A | * | 8/1979 | Wandler | 362/226 |
| 4,229,785 | A | | 10/1980 | Tuller | |
| 4,345,178 | A | | 8/1982 | Pappas et al. | |
| 4,412,276 | A | | 10/1983 | Blinow | |
| 4,428,039 | A | | 1/1984 | Guimond et al. | |
| 4,626,734 | A | | 12/1986 | Greiler | |
| 4,747,033 | A | | 5/1988 | Yasuda | |
| 4,809,147 | A | | 2/1989 | Negishi | |
| 4,851,975 | A | | 7/1989 | Kanai | |
| 4,868,727 | A | | 9/1989 | Ponds | |
| 4,891,739 | A | | 1/1990 | Yasuda | |
| 4,918,582 | A | * | 4/1990 | McIngvale et al. | 362/217 |
| 4,935,668 | A | | 6/1990 | Hansler et al. | |
| 4,990,819 | A | | 2/1991 | Narby | |
| 5,016,150 | A | | 5/1991 | Gordin | |
| 5,119,275 | A | | 6/1992 | Makita | |
| 5,229,681 | A | | 7/1993 | Gordin et al. | |
| 5,337,221 | A | | 8/1994 | Gordin et al. | |
| 5,343,374 | A | | 8/1994 | Gordin et al. | |
| 5,363,293 | A | | 11/1994 | Lasker | |
| 5,402,327 | A | | 3/1995 | Gordin et al. | |
| 5,510,964 | A | * | 4/1996 | Spitler et al. | 362/217 |
| 5,519,590 | A | | 5/1996 | Crookham | |
| 5,532,911 | A | * | 7/1996 | Sutherland | 362/220 |
| 5,595,440 | A | | 1/1997 | Gordin | |
| 5,608,227 | A | | 3/1997 | Dierks et al. | |
| 5,647,661 | A | | 7/1997 | Gordin | |
| 5,707,142 | A | * | 1/1998 | Gordin | 362/346 |
| 5,800,048 | A | | 9/1998 | Gordin | |
| 5,887,969 | A | | 3/1999 | Gordin | |
| 6,220,726 | B1 | | 4/2001 | Gordin | |
| 2003/0147240 | A1 | | 8/2003 | Gordin et al. | |

OTHER PUBLICATIONS

OSRAM–Sylvania, High Intensity Discharge METALARC Lamos– Engineering Bulletin, Aug. 1998, complete disclosure.*

Journal of the Illuminating Engineering Society, "A New Generation of Metal Halide Lamps", vol. 4, No. 2, pp. 106/110, Jan. 1975.

* cited by examiner

| PART # | DESCRIPTION |
|---|---|
| 18 | .125 THK. ALUM. 5052-H32 |
| 134L&R | .100 THK. ALUM. 5052-H32, ANODIZE PER MIL SPEC MIL-A-8625F, TYPE II, CLASS 1, CLEAR, LIGHT ETCH. |
| 202 | .020 THK. PREANODIZED ALUM. (REFLECTOR SHEET)<br>OVERLAP (3" ) TEFLON TAPE OVER END AND TRIM W/ SCISSORS, 99% PTFE. TEFLON, GRADE: MILITARY, TEMP RANGE: -400°-+500°F,<br>WIDTH: 1.50, THICKNESS: .003, ELONGATION: 50% MIN.,<br>SPEC. GRAVITY: 0.90 G/CC, COLOR: WHITE, SPECS. MEETS MILITARY SPEC. T-277-30A. |
| 204 | .080 THK. ALUM. 5052-H32 |
| 206 | .060 ALUM. 5952-H32 |
| 208 | .030 THK. ALUM. 5052-H32, STAINLESS STEEL 302 SPRING TEMPER |
| 210 | .060 THK. ALUM. 5052-H32 |
| 300 | .060 THK. ALUM. |

Fig. 3B

.015 THK. 300 SERIES
SS FULL HARD TEMPER
ROCKWELL C40-45.
(PASSIVATE PER
ASTM A 380)

COATING MUST BE CENTERED
±5° WHEN LAMP IS PLACED
INTO LAMP HOLDERS

LAMP LOCATOR WILL LOCATE
OFF OF CERAMIC HOLDER AND
SIDES OF PINCH SEAL

NOTES:

1. REFLECTIVE COATED PARTS SHALL HAVE A TRANSMISSION AT NORMAL INCIDENCE OF LESS THAN 1% AVERAGE FROM 400NM TO 700 NM, AND GREATER THAT 70% AVERAGE TRANSMISSION AT NORMAL INCIDENCE FROM 800NM TO 1500NM. COATING SHALL BE DESIGNED FOR GREATER THAN 90% REFLECTION FROM 400NM TO 700NM.

2. REFLECTIVE COATING SHALL SURVIVE RAPID THERMAL SHOCK TO 900 DEGREES C. THIS SHALL BE TESTED FOR BY INSERTION OF A COATED WITNESS PLATE INTO A TEST CHAMBER HELD AT 900 DEGREES C; HOLDING THE WITNESS AT ROOM TEMPERATURE FOR 30 MINUTES, AND RAPID WITHDRAWAL OF THE WITNESS TO ROOM TEMPERATURE.
THE COATING ON THE WITNESS PLATE SHALL SURVIVE THIS TEMPERATURE CYCLE WITH NO LOSS OF COATING.

3. REFLECTIVE COATING SHALL SURVIVE STANDARD 24 HOUR HUMIDITY TEST AT 49 DEGREES C. AND PASS QUICK TAPE TEST.

4. FILM CRACKING AND CRYSTALLIZATION OF THE REFLECTIVE COATING SHALL BE ACCEPTABLE, PROVIDED THAT NO COATING VOID SHALL BE LARGER THAT 0.010 INCHES IN ITS LARGEST DIMENSION.

5. COAT 360 DEGREES OF THE ARC TUBE WITH UV BLOCKING FILM. THE UV BLOCKING SHALL PRODUCE A COATING DESIGNED TO HAVE T < OR = 1% AVERAGE FROM 200NM TO 390NM WHILE MAINTAINING T > OR = 95% AVERAGE IN THE VISIBLE, APPROXIMATELY 400NM TO 700NM. THE FILM MUST WITHSTAND LONG TERM EXPOSURE TO APPROXIMATELY 1000° C.

Fig. 7E

NOTE:
1. DIMENSIONS IN ( ) ARE INCHES.
2. DIMENSION IS THE ARC LENGTH.
3. SYLVANIA LAMP NUMBER M2000T9/DE

304
STANYL TW
P300/TW 341

0.63
ø0.22 ø0.33ø
304
45°
ø0.20
SECTION: A-A
0.84
ø0.190
R0.03
ø0.110
4x45°x.02

0.10
A
304
3.88
2.67
2X0.37
B
2X0.47
A
B
2x.05
2x.0.10

304
0.64
0.61
44°
VIEW: B-B
0.15
0.08
89°

304
□0.30
2x0.15
□0.38
2x0.19

SECTION: A

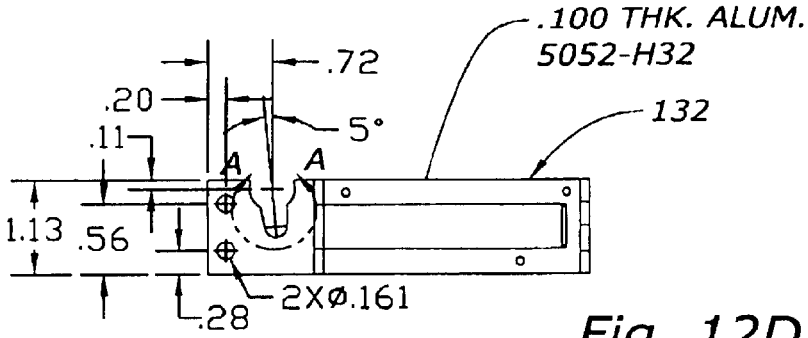
Fig. 12D
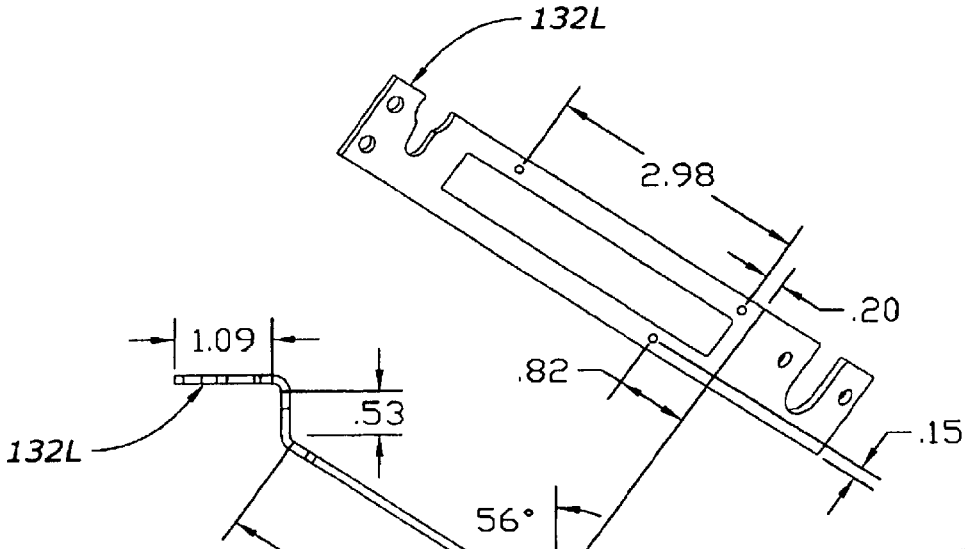
Fig. 12E
Fig. 12F

NOTE:
1. NO FINGER PRINTS OR FOREIGN MATTER ON MIRROR. USE WHITE COTTON GLOVES WHEN ASSEMBLING.
2. DO NOT ATTEMPT TO CLEAN MIRROR.

NOTE:
1. COATING: DICHROIC COLD COATING WITH A REFLECTANCE OF >94% FROM 430–680 NM.
2. CURVATURE IS A 3-5/16" FOCAL LENGTH PARABOLA.

| "X" RAD | "Y" DIM |
|---|---|
| .911 | .063 |
| 1.287 | .125 |
| 1.576 | .188 |
| 1.820 | .250 |
| 2.035 | .313 |
| 2.229 | .375 |
| 2.408 | .438 |
| 2.574 | .500 |
| 2.730 | .563 |
| 2.878 | .625 |
| 3.018 | .688 |
| 3.152 | .750 |
| 3.281 | .813 |
| 3.405 | .875 |
| 3.524 | .938 |
| 3.640 | 1.000 |
| 3.752 | 1.063 |
| 3.861 | 1.125 |
| 3.967 | 1.188 |
| 4.070 | 1.250 |
| 4.170 | 1.313 |
| 4.268 | 1.375 |
| 4.364 | 1.438 |
| 4.453 | 1.497 |

Fig. 13G

LIGHTING FIXTURE WITH QUICK-DISCONNECT LIGHT SOURCE MOUNT

BACKGROUND OF THE INVENTION

1. Field of the Invention

The present invention relates to high intensity lighting fixtures, and in particular, to unjacketed, double-ended high intensity discharge (HID) lamps and fixtures for wide area lighting of relatively distant targets, such as in sports lighting.

2. Problems in the Art

High intensity discharge lamps, such as used in sports lighting, require high operating electrical power to operate lamps that usually are on the order of 1000 watts or greater. Also, HID lamps such as metal halide or mercury HID lamps generate ultraviolet (UV) radiation. Both of these characteristics of such HID lamps create safety issues, particularly for persons that install, maintain or repair such fixtures.

Some HID fixtures address these issues by utilizing screw-in lamps so that there are no directly exposed current-carrying parts. These lamps also usually have glass envelopes surrounding the arc tube. The glass absorbs a sufficient amount of UV radiation so that it does not pose a serious risk to workers, even if in close proximity to the lamps when operating.

A particular type of HID lamp does not have any glass envelope surrounding the arc tube. It also has opposite ends usually with short leads with exposed ends that are connected to exposed electrical connection posts in the fixture. Although such fixtures usually have glass lens over the front of the reflector for the fixture, which blocks UV radiation, when the lens is opened, that UV protection is removed. Also, the exposed current carrying surfaces pose risk.

Entities such as Underwriters Laboratories (UL) have standards for such fixtures (also sometimes called luminaries), which directly address the safety concerns with high-powered electricity and UV radiation relative to double-ended unjacketed HID lamps. See, for example, UL standards 1598. Sections 3.4, 6.4, and 6.5 require each fixture to have safety interlock switches which automatically disconnect electrical power to the fixture when the lens assembly is removed. The automatic disconnection of power is not only intended to prevent any risk of electrical shock, even if normally current carrying exposed surfaces are touched, but also, is intended to prevent any risk of UV exposure.

The state of the art follows these standards by either jacketing HID lamps or utilizing some type of automatic power disconnect, usually by some type of switch or switches. Some embed electrically conducting wire or ribbon in the lens. If the lens is broken, the wire or ribbon is broken and causes an automatic disconnect of power to the fixture, or at least to the exposed current-carrying parts or surfaces.

The problems with these types of state of the art solutions include the risk of failure of the automatic switches. The environment of these switches, in fixtures operating at high power and putting out significant heat, can result in unreliability for the automatic power disconnect switches or other automatic power disconnect structure(s).

Also, such switch(es) and structure(s) add to the complexity and cost of such fixtures. They can also add to the difficulty in accessing, working on, and replacing or repairing parts in the fixture.

Many types of the state of the art fixtures require use of tools to install and remove the lamps or other parts. Many times these fixtures are elevated to substantial heights in the air (e.g. on poles 35 feet to over 100 feet tall) or in rafters or on other elevated structures. It is cumbersome and adds additional risk to the worker to have to handle tools as well as be careful about not dropping anything, avoiding electrical shock and avoiding burns.

Therefore, there is a real need in the art for improvement. It is therefore a principle object, feature, or advantage of the present invention to improve upon the state of the art.

SUMMARY OF THE INVENTION

The present invention includes a lighting fixture which improves upon the state of the art in at least the following ways.

It shields the lamp lead connections to electrical power from direct exposure to a worker by utilizing connections that even when separated, do not allow direct contact by even the fingers of a worker.

It associates a UV block with the arc tube so that even if a worker is exposed to the arc tube when the fixture lens is removed, UV attenuation occurs at or near the arc lamp and UV radiation of a risky level is blocked from reaching the worker.

It does not require automatic power disconnect switches or other structure for automatic disconnect of power.

It provides easy and quick disconnection of power to the lamp, removal and replacement of the lamp as well as other parts, all without tools.

It thus reduces the cost and complexity of such fixtures, and the risk of malfunction of some switch or other structure, while retaining safety standards.

These and other features, objects, or advantages of the invention will become more apparent with reference to the other parts of this application and description and claims.

BRIEF DESCRIPTION OF THE DRAWINGS

FIGS. 3A–B is an exploded view of an arc lamp, lamp holder, parabolic reflector insert, and electrical connector assembly.

FIGS. 7A–E and 8A–D are still further enlarged isometric views of exemplary arc lamps that can be used in the lamp and connector assembly of FIGS. 4, 5, and 6A–C.

FIGS. 12A–F are isometric views and details of the lamp holder assembly of FIGS. 3A–B.

FIGS. 13A–H are isometric and detail views of the parabolic reflector assembly of FIGS. 3A–B and how it mounts in reflector 18.

DETAILED DESCRIPTION OF AN EXEMPLARY EMBODIMENT

General Environment of One Embodiment

Figure 1:
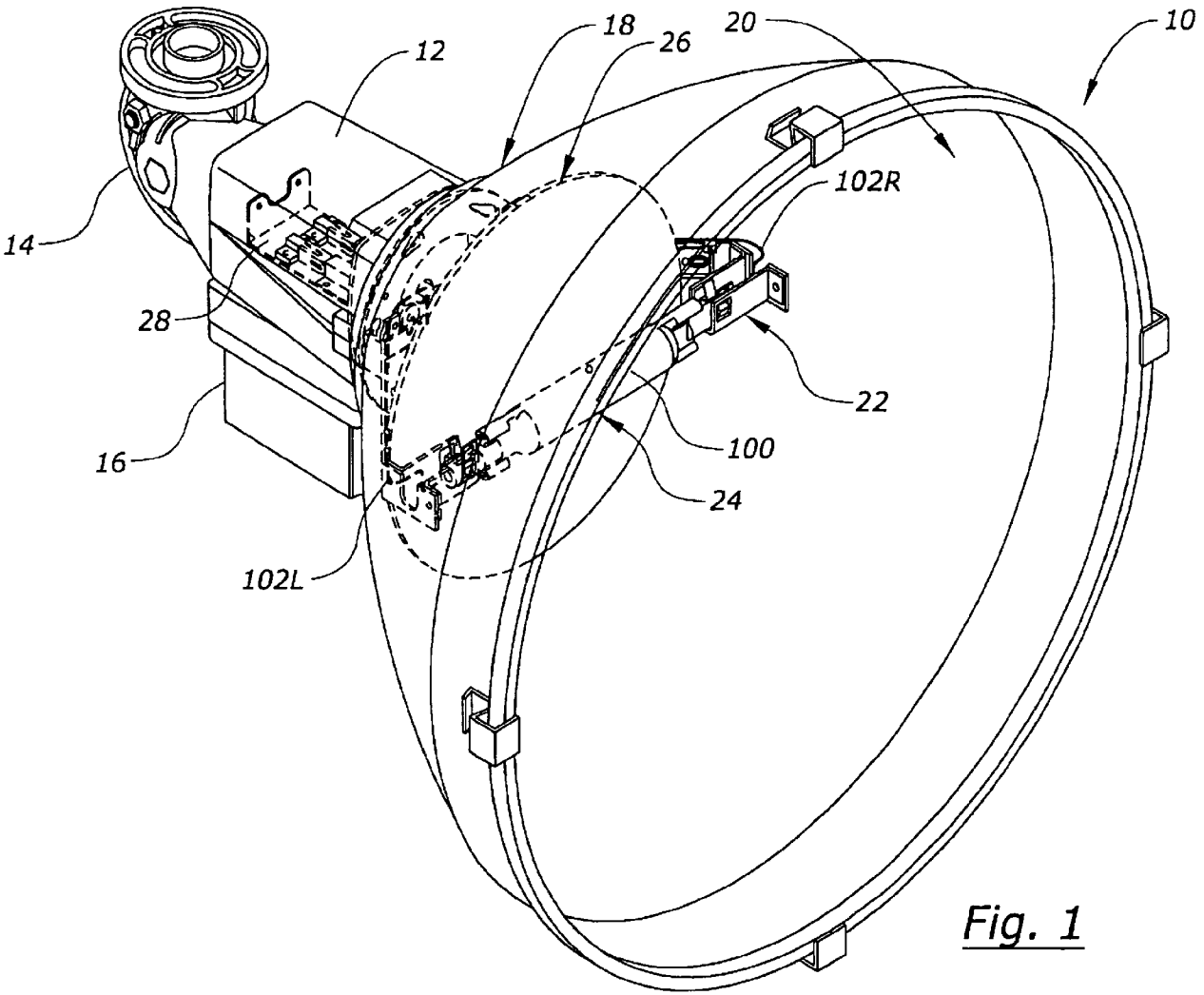
FIG. 1 is an assembled perspective view of an embodiment according to the present invention.

To achieve a better understanding of the invention, one embodiment will now be described and illustrated in detail. Frequent reference will be made to the appended drawings. Reference numerals will be used to indicate certain parts and locations in the drawings. The same reference numbers will be used to indicate the same or similar parts and locations throughout the drawings, unless otherwise indicated.

The general environment of the embodiment described below will be that of sports lighting. Examples include outdoor lighting of football, soccer, baseball, softball, and other sports fields where banks or arrays of HID fixtures are elevated from poles or structures (e.g. >35 feet tall). Examples also include indoor lighting where banks or arrays are suspended from rafters or beams or other structures.

Sports lighting of this type generally utilizes HID lamps of at or above 1000 watts rating. Reflectors are used to generate relatively narrow beams (especially in the vertical plane) that can be controlled and concentrated substantial distances (many times over a hundred feet) to a target area such as a playing field.

In this embodiment, unjacketed double-ended HID lamps of 2000 watt rating are used.

Detailed Description of One Embodiment

Fixture Generally

Figure 2:
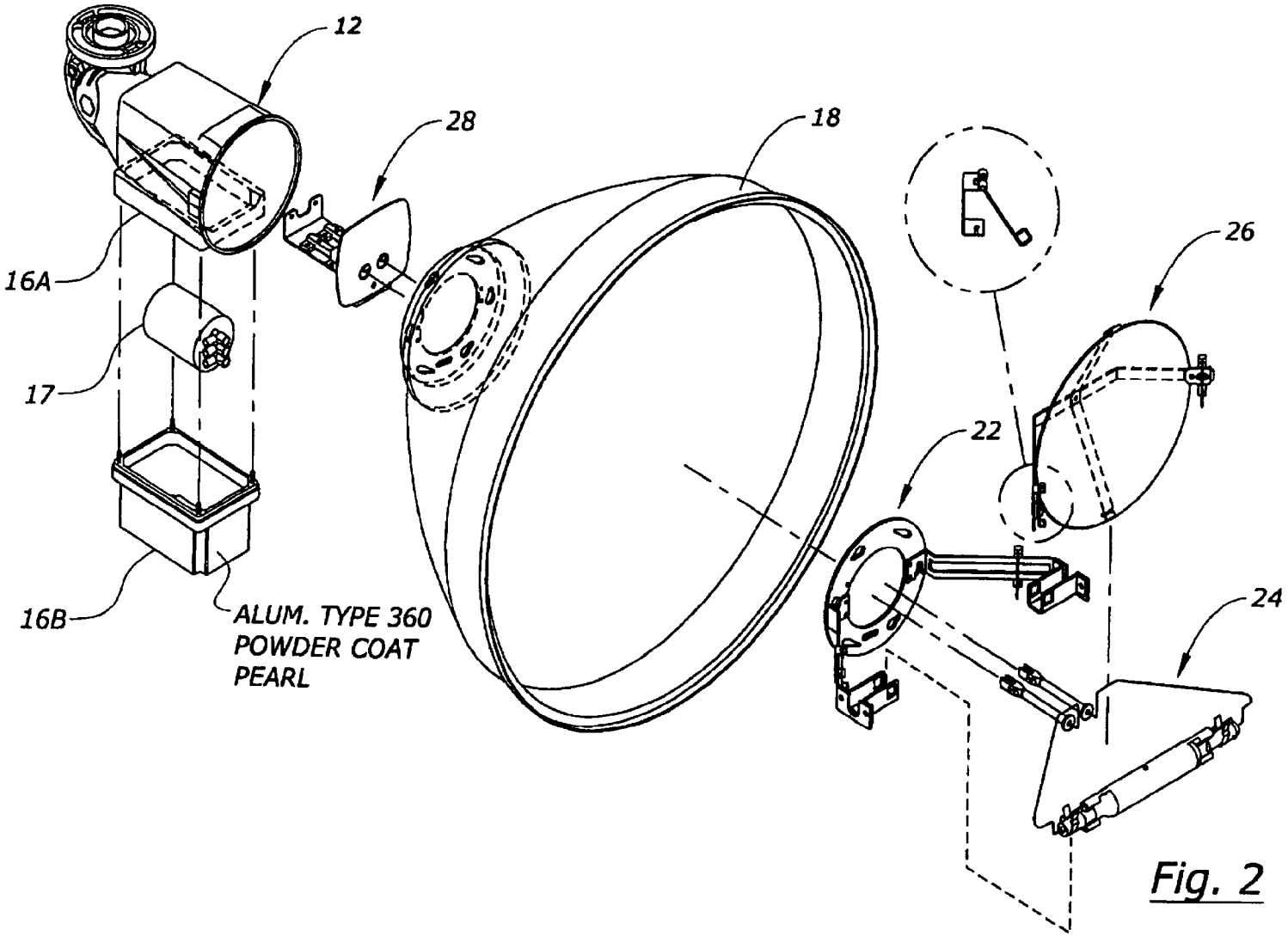
FIG. 2 is an exploded view of FIG. 1.

FIGS. 1 and 2 illustrate an exemplary embodiment of a fixture 10, according to the present invention. As shown in FIGS. 1 and 2, the major sections or parts of fixture 10 include a cone 12 enclosing a connector assembly 28 and providing a connection to an adjustable mounting elbow 14 on one end and a reflector/lens assembly 18/20 on the other. A box assembly 16 is mounted to cone 12 and houses an igniter. A lamp holder assembly 22 is connected to the base of reflector 18 and provides for snap-in and out of lamp assembly 24. A parabloid refelector assembly 26 is also removably mounted to the lamp holder assembly 22, and serves to reflect light energy from lamp assembly 24, but is removably mounted to allow access to cone 12 for installation and maintenance.

FIG. 1 shows fixture 10 substantially assembled, but with dashed-lines that shows how the interior parts are positioned.

FIG. 1 illustrates in detail how leads 102L (left) and 102R (right) are generally positioned in assembled form between lamp or arc tube 100 and connector assembly 28, which is in operative communication with an electrical power source (not shown).

FIG. 2 illustrates the major parts of fixture 10 in exploded fashion. As can be appreciated, when installing fixture 10, connection assembly 28 is mounted inside cone 12, and reflector 18 to cone 12 by means known within the art using the reinforcing ring (a part of lamp holder assembly 22) shown at FIGS. 1 and 2. Lamp holders 132L and R are also mounted to the reinforcing ring. Parabloid reflector assembly 26 has mounting structure that allows it to be removably locked into a holding position in lamp holder assembly 22. Likewise lamp assembly 24 is removably mountable into lamp holder assembly 22.

Thus, once assembled, to work on fixture 10, a worker can disconnect the finger-safe connections 1104L/R and 304L/R to disconnect electrical power to lamp 100. This can be done easily, without risk that even the workers fingers can contact live electrical surfaces. Finger-safe connections are available commercially. Those shown in the FIGS. are specially made to allow a worker to grip and manipulate them, and so that they can handle and have longevity in the environment of fixture 10 and the electrical power and heat experienced by it. An example of such finger-safe connections can be found at co-pending U.S. Ser. No. 09/076,278, commonly-owned by the owner of this application, and incorporated by reference herein.

Cone

Cone 12 is shown at FIGS. 1 and 2. It functions conventionally, except that igniter box 16B is attachable as discussed below.

Elbow

Likewise, elbow 14 is substantially shown in detail at FIGS. 1 and 2. It too functions conventionally.

Box Assembly

Box assembly 16 is shown in detail at FIGS. 1 and 2. Note particularly that it encloses and houses an igniter 17 for fixture 10 (see FIG. 2). But also, note that it does not have to include ballast for fixture 10. In this embodiment, ballast for fixture 10 is located remotely (e.g. down at the bottom of the pole elevating fixture 10). This allows for much easier access to the ballasts and removes the ballast from the fixture, and its weight and bulk.

Box 16B is connected to cone 12 by screws, bolts, or other means (see through-channels in corners of box 16). An ignitor circuit (not shown), such as are known in the art therefore can be placed relatively closely to the arc lamp 100, but away from the heat generated interiorly of reflector 18. For this power rating of HID lamp, the ignitor is pulsing a very high voltage level (e.g. 5000 volts), but at relatively low amperage. Therefore, electrical power of this nature tends to dissipate over distance more quickly than if at higher amperage. Placing box 16B close to lamp 100 reduces or eliminates this problem. It also allows the ballast(s) for lamp 100 to be placed at a different location. For example, the ballast(s) can be placed in an enclosure nearer the base of the pole. They are easier to reach and repair and this would reduce weight and wind load at the lighting fixture. An appropriate opening can be made in cone 12 to allow wiring or cables from an ignitor circuit in housing 16 to pass into cone 12.

Reflector and Lens Assembly

Reflector 18 and its reinforcing ring are shown at FIGS. 1, 2 and 3A–B and function conventionally. The reflecting properties of reflector 18 can be selected according to need.

Lamp Assembly

By referring to FIGS. 3A–B, 5, 6A–C, 7A–E, and 8A–D, the HID arc lamp or tube 100 is illustrated in detail. It is a 2000-watt lamp, double-ended and unjacketed. Note that electrical leads 102L and R are completely covered along their lengths by an electrically insulating sleeving 103 (see FIG. 4), are electrically insulated at the ends of lamp 100 by ceramic or other insulating members and have finger-safe male connectors at opposite ends. Therefore, there are no electrically conducting surfaces that a worker can directly contact with his/her fingers.

Figure 5:
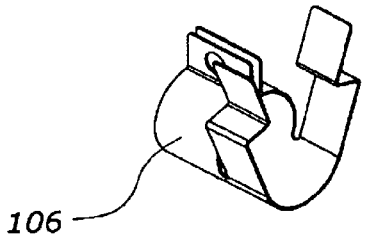
Figure 6A:
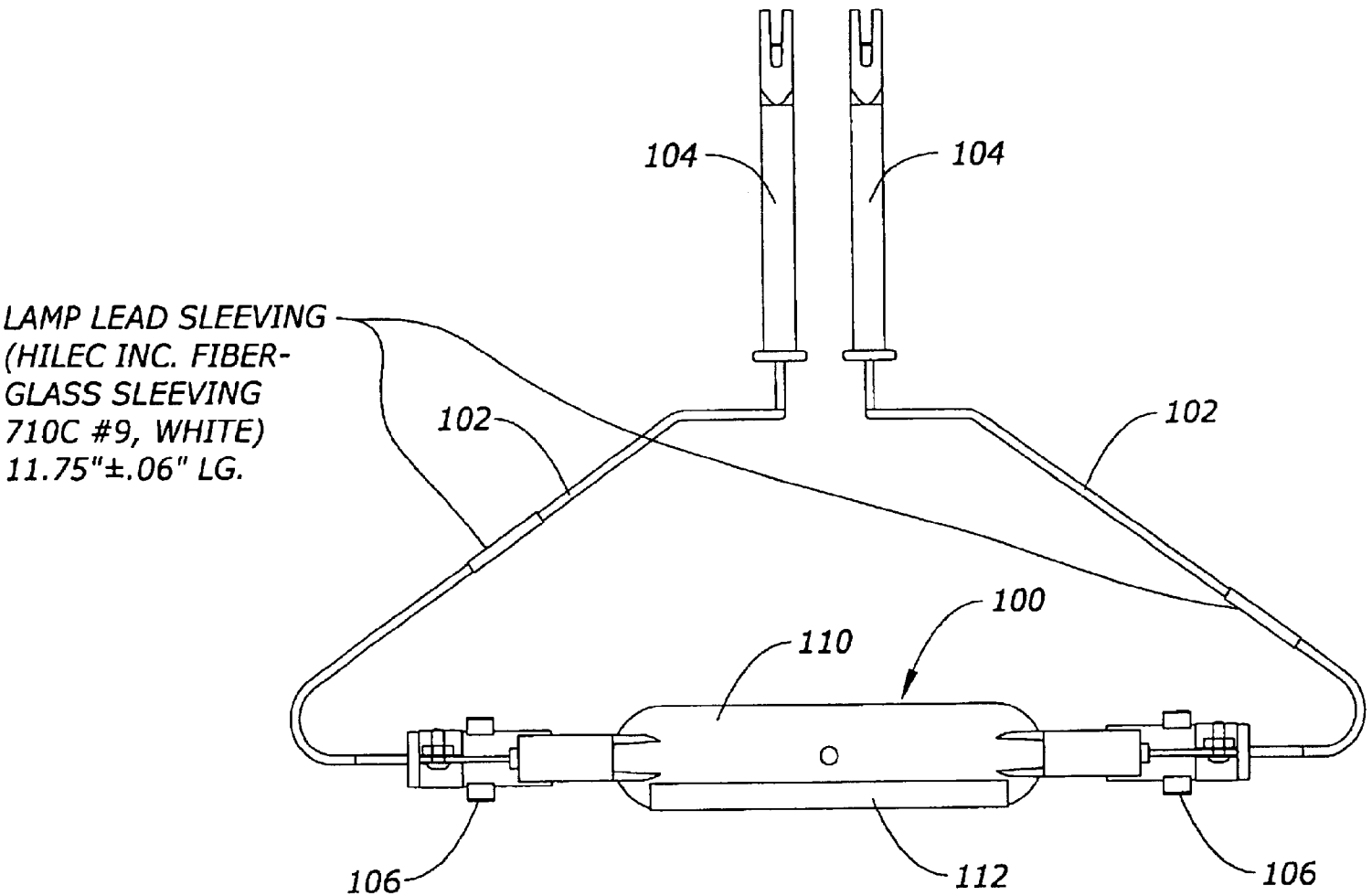
Figure 6B:
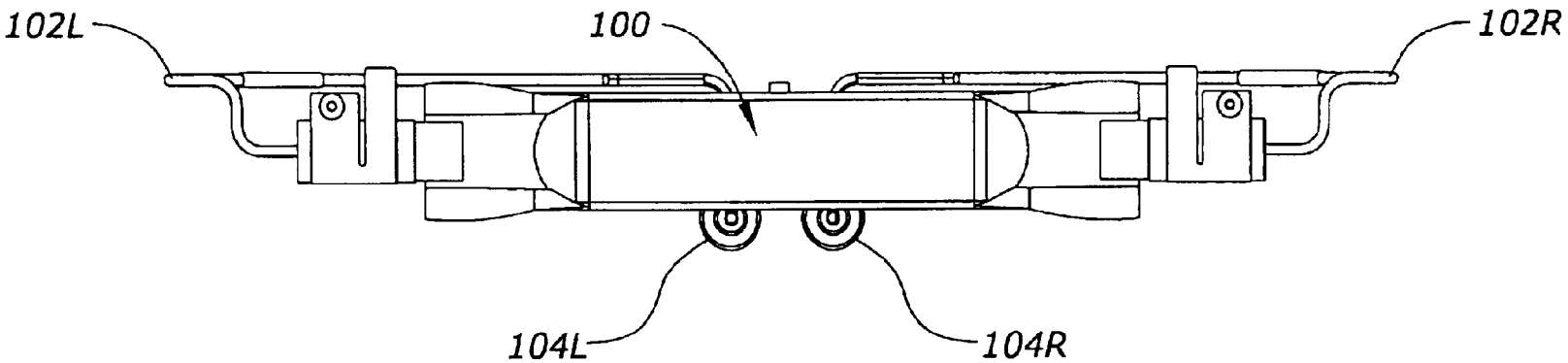
Figure 6C:
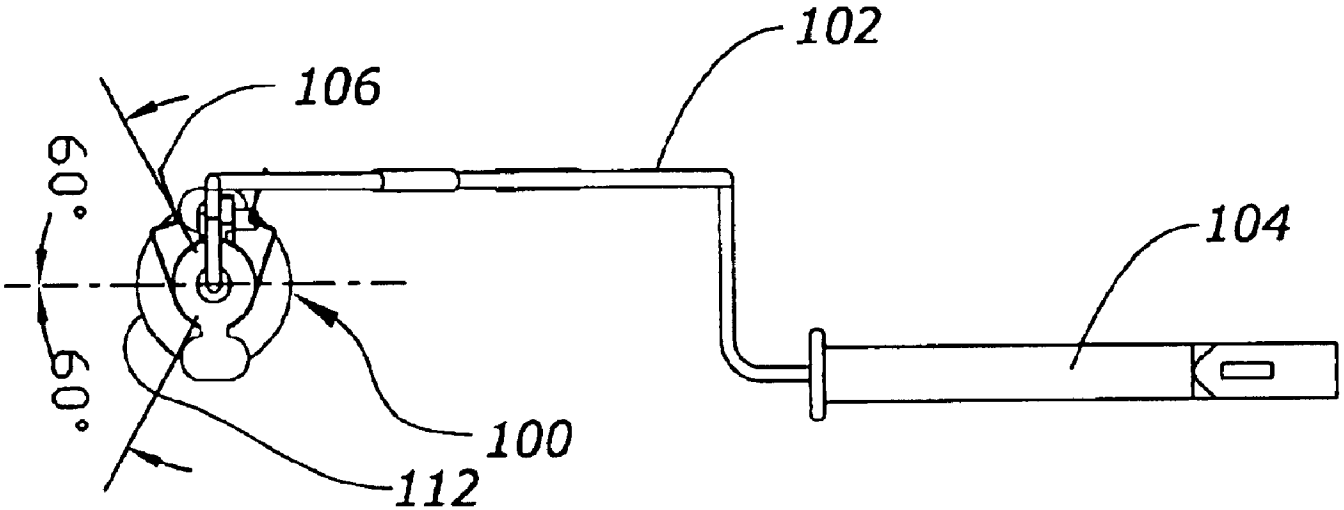
Figures 7A, 7B, 7C, 7D:
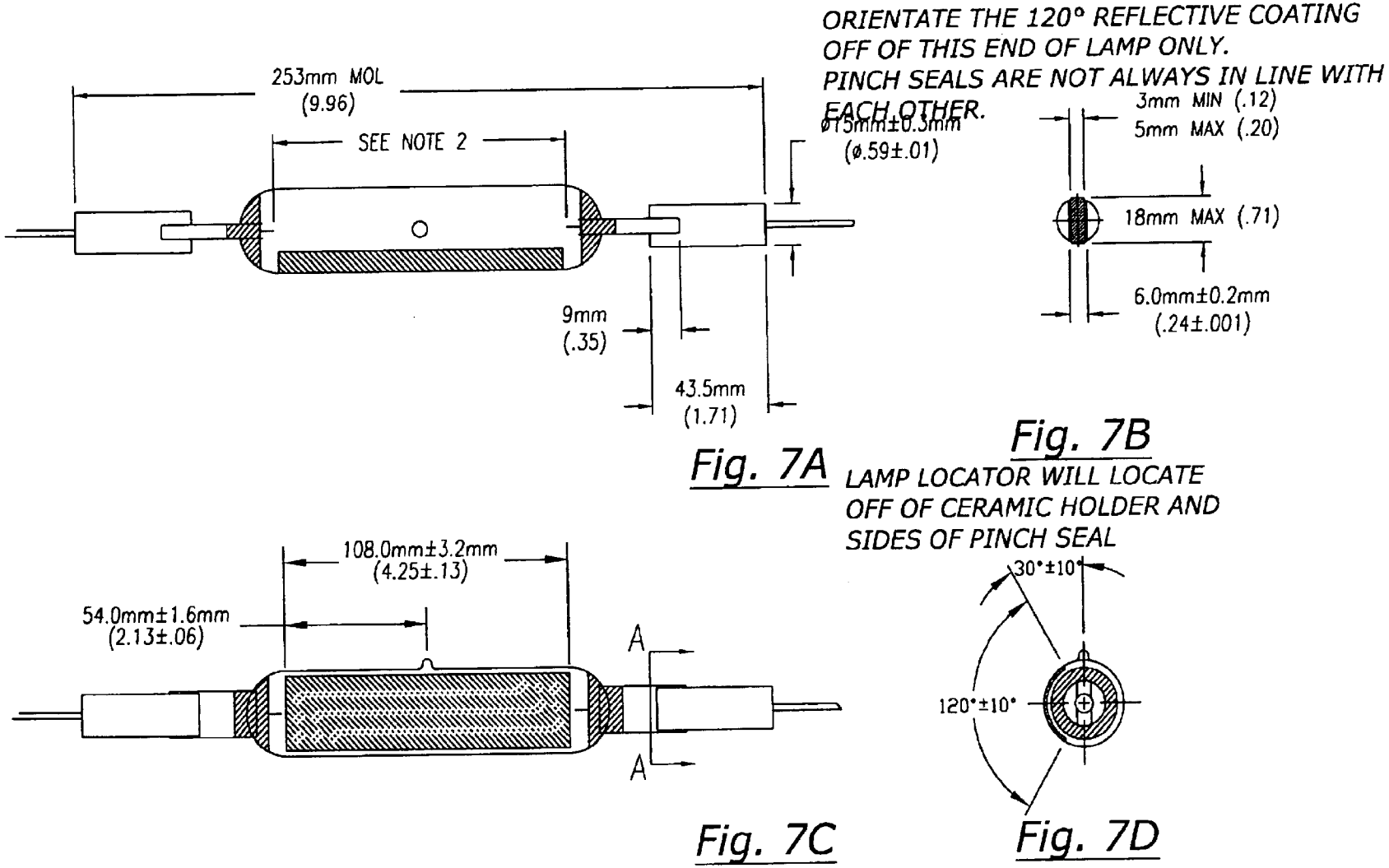
Figure 8B:
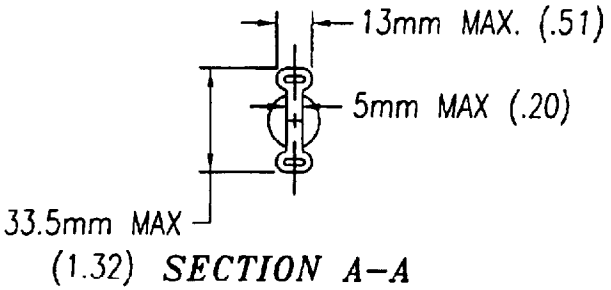
Figure 8D:
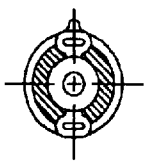
Figure 8A:
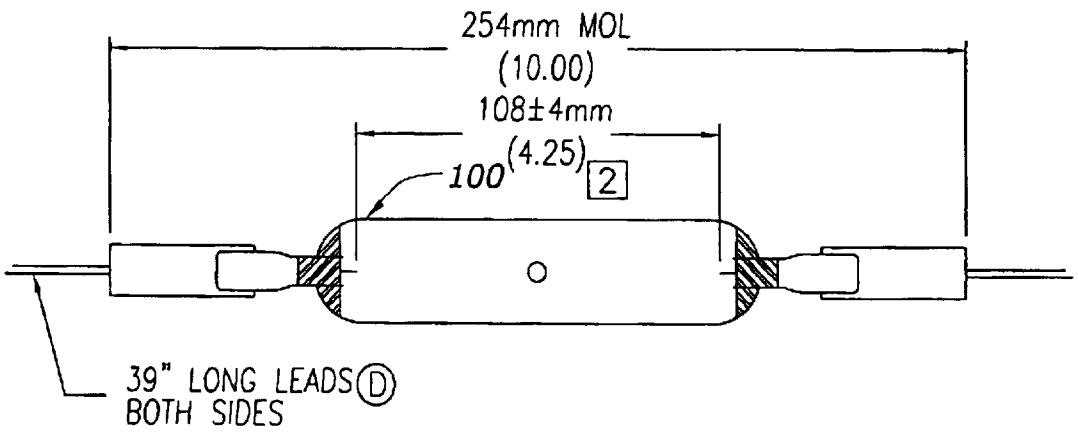
Figure 8C:
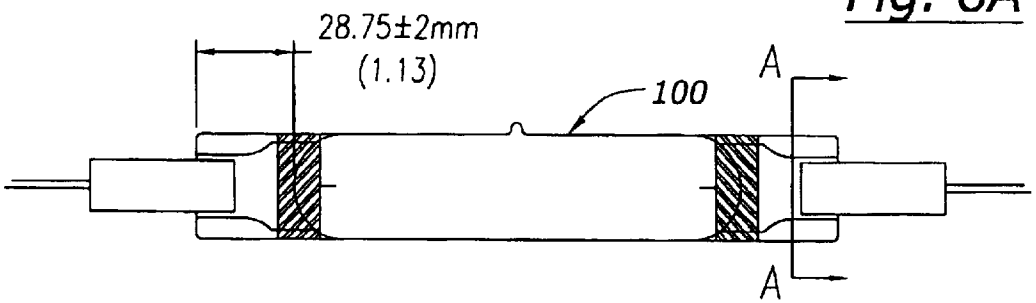
Figure 9B:
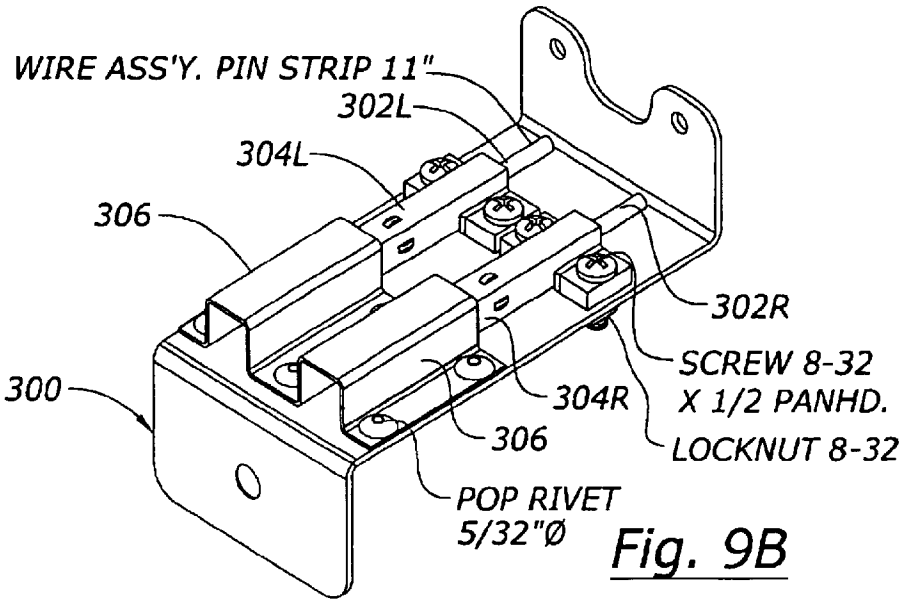
FIGS. 9A–D are isometric and detail views of the connector assembly 28 of FIGS. 1 and 3A–B.
Figure 9D:
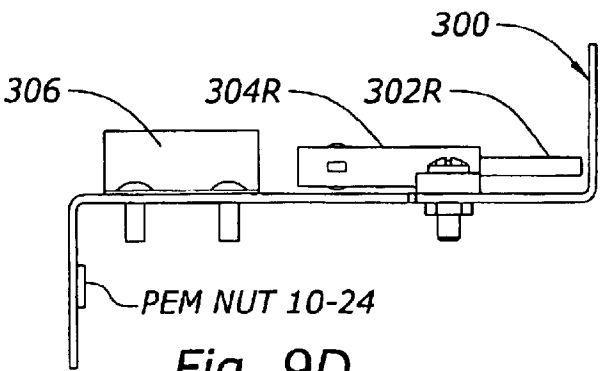
Figure 9A:
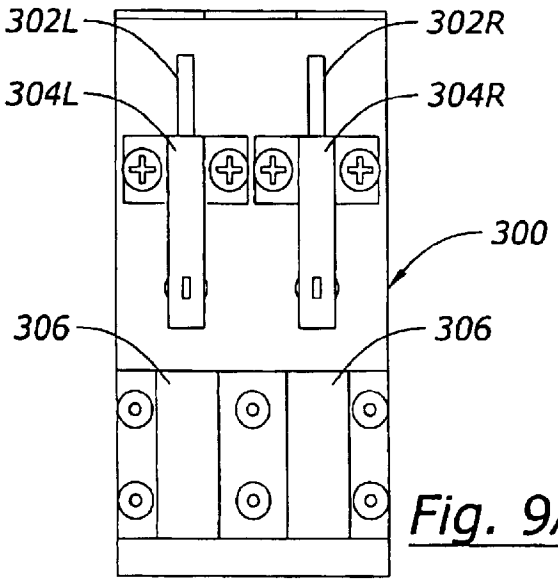
Figure 9C:
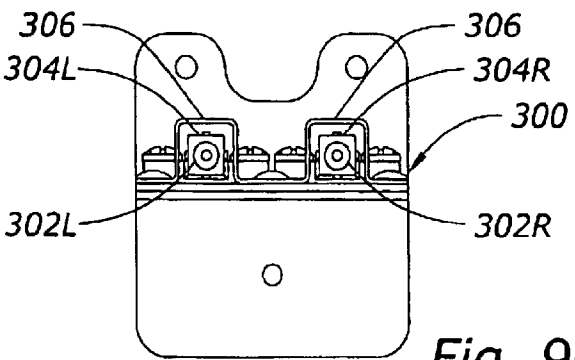
Figures 10A, 10B, 10C, 10D, 10E:
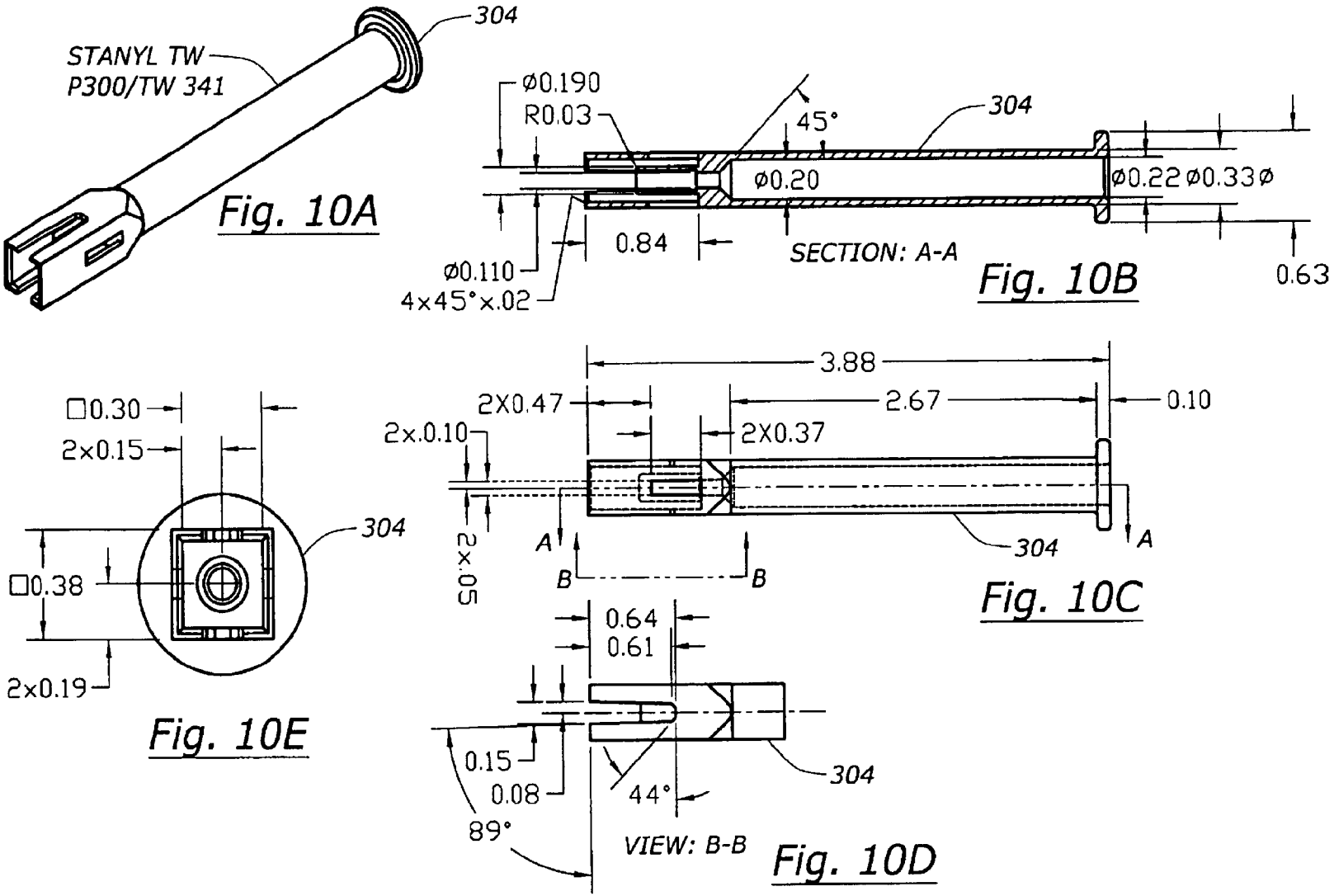
FIGS. 10A–D are isometric views and details of connector 104.
Figure 11A:
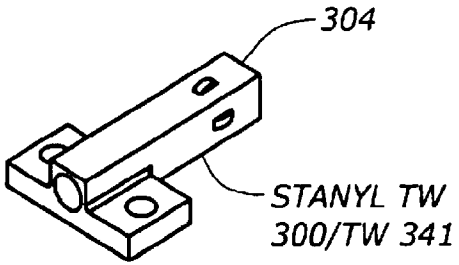
FIGS. 11A–E are isometric views and details of connector 304.
Figure 11B:
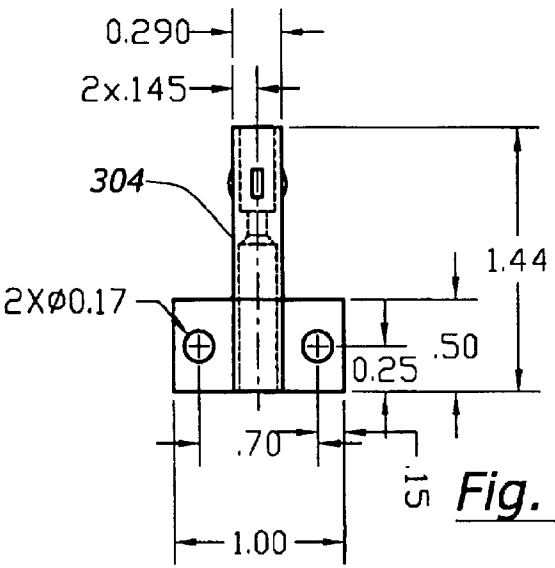
Figure 11C:
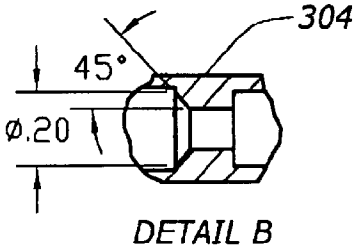
Figure 11D:
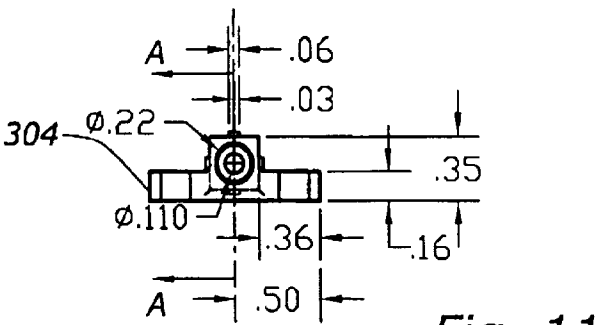
Figure 11E:
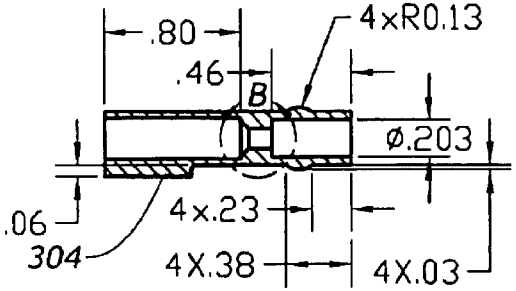
Figure 12A:
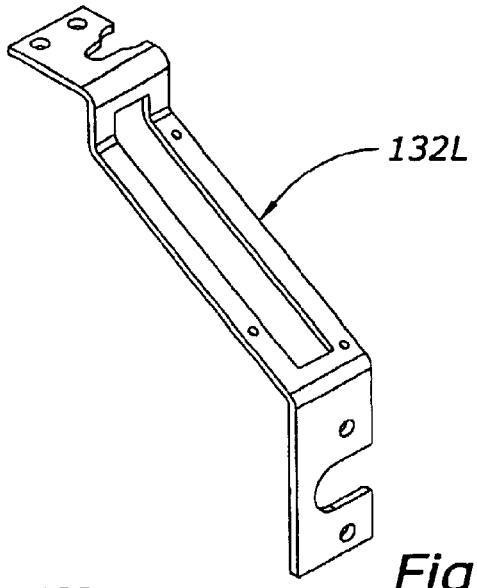
Figure 12B:
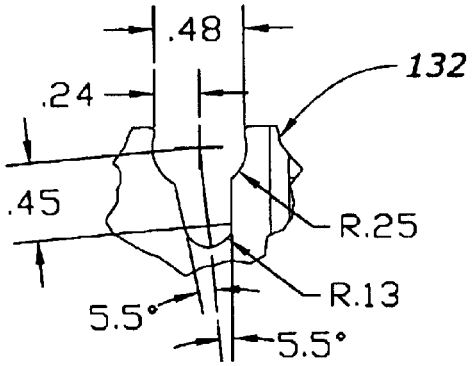
Figure 12C:
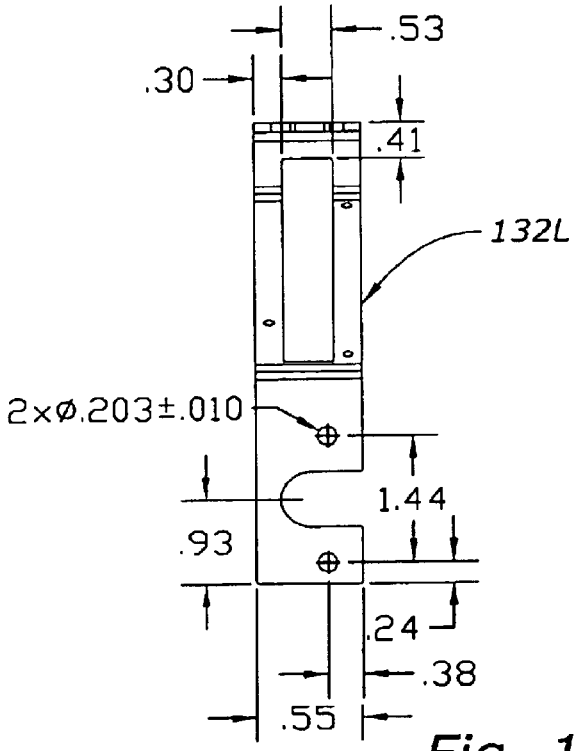
Figure 13A:
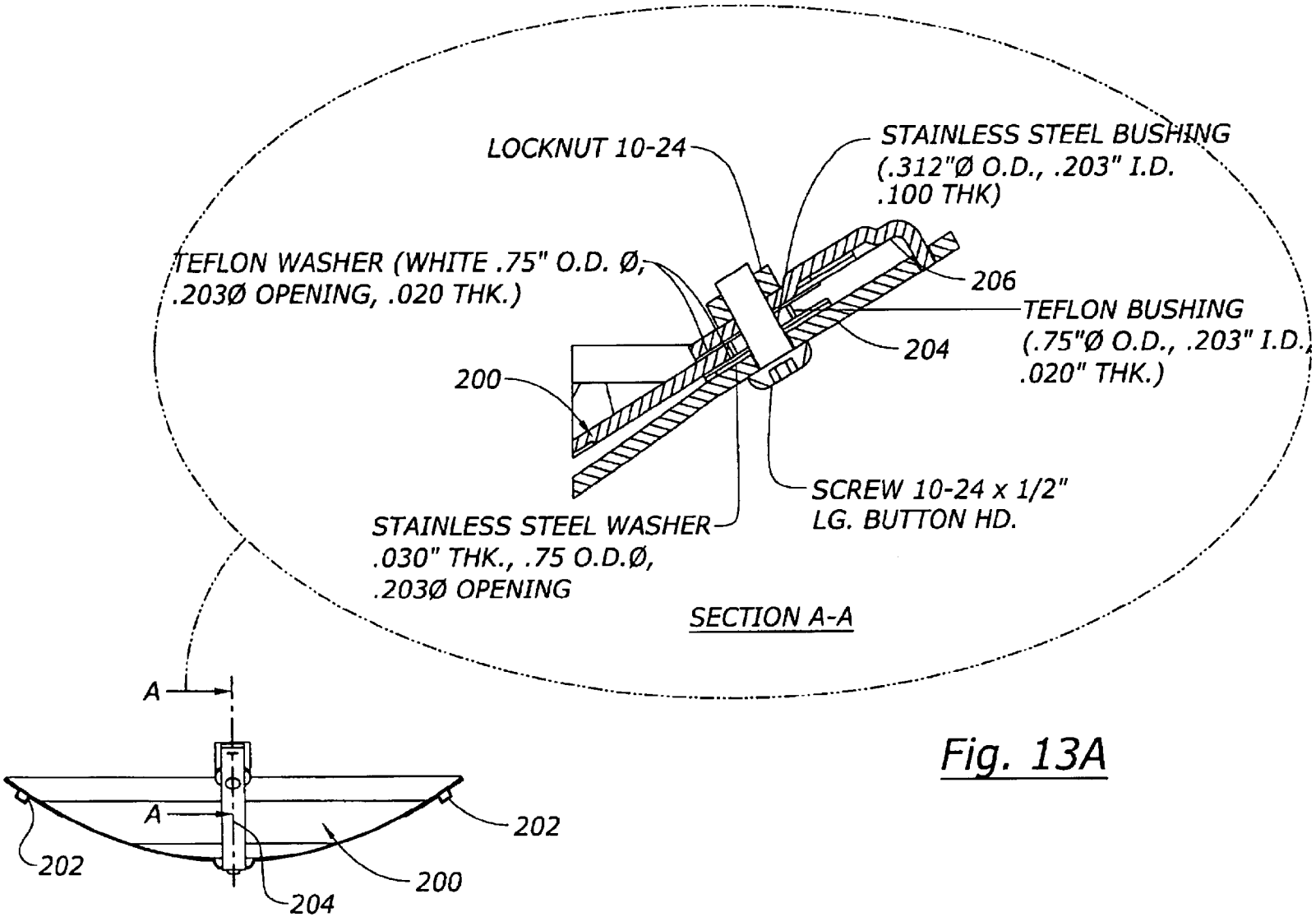
Figure 13B:
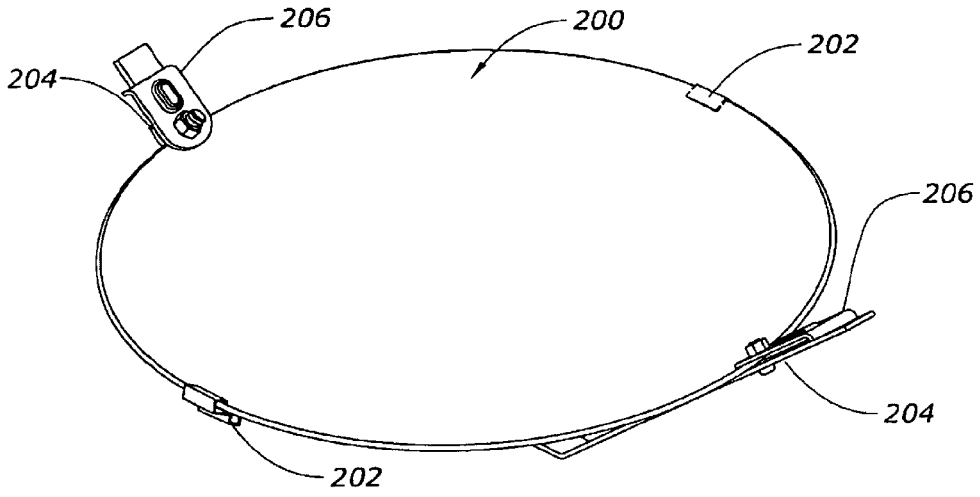
Figure 13C:
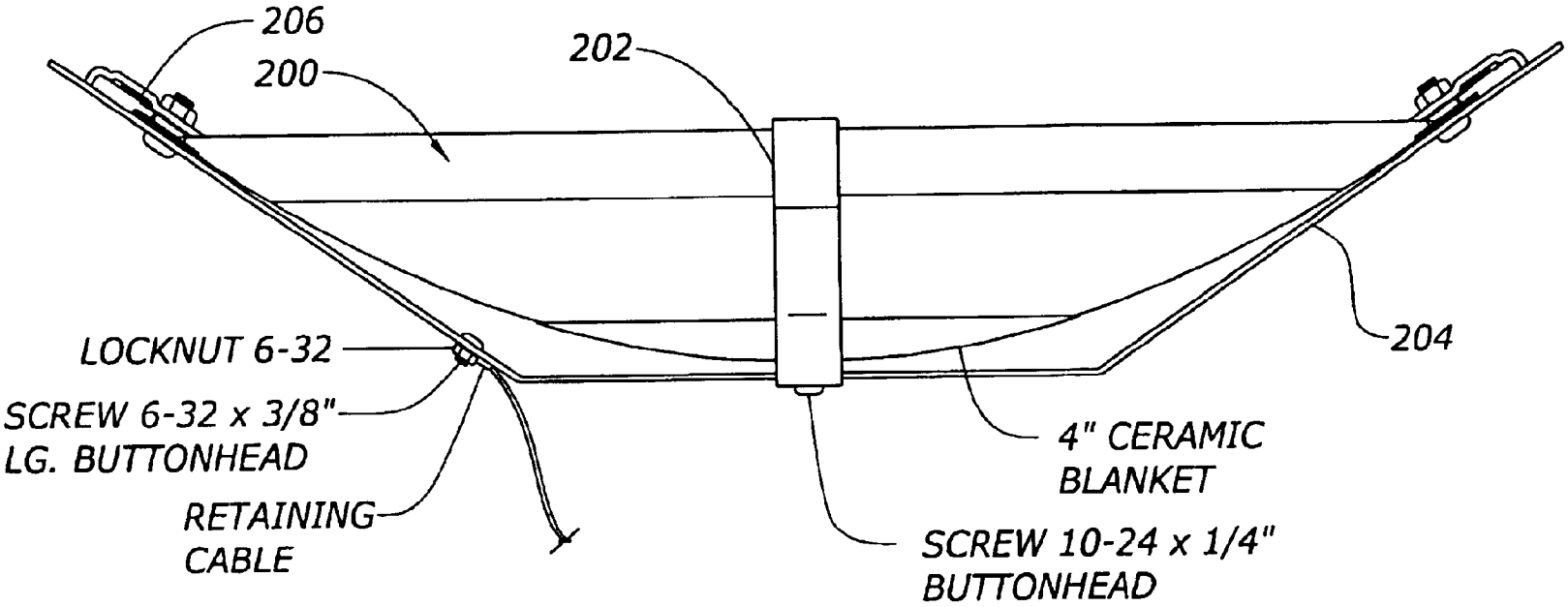
Figure 13D:
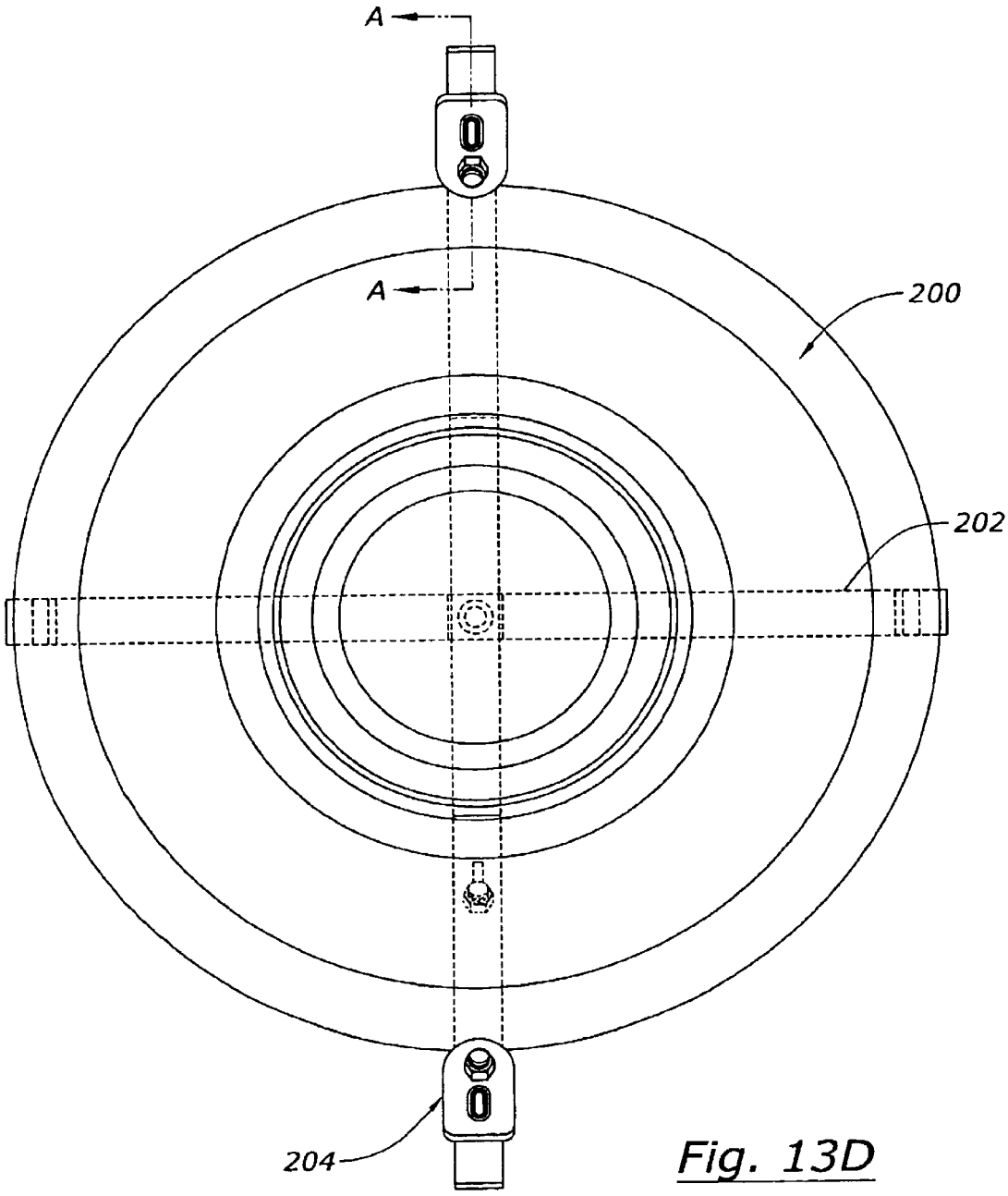
Figure 13E:
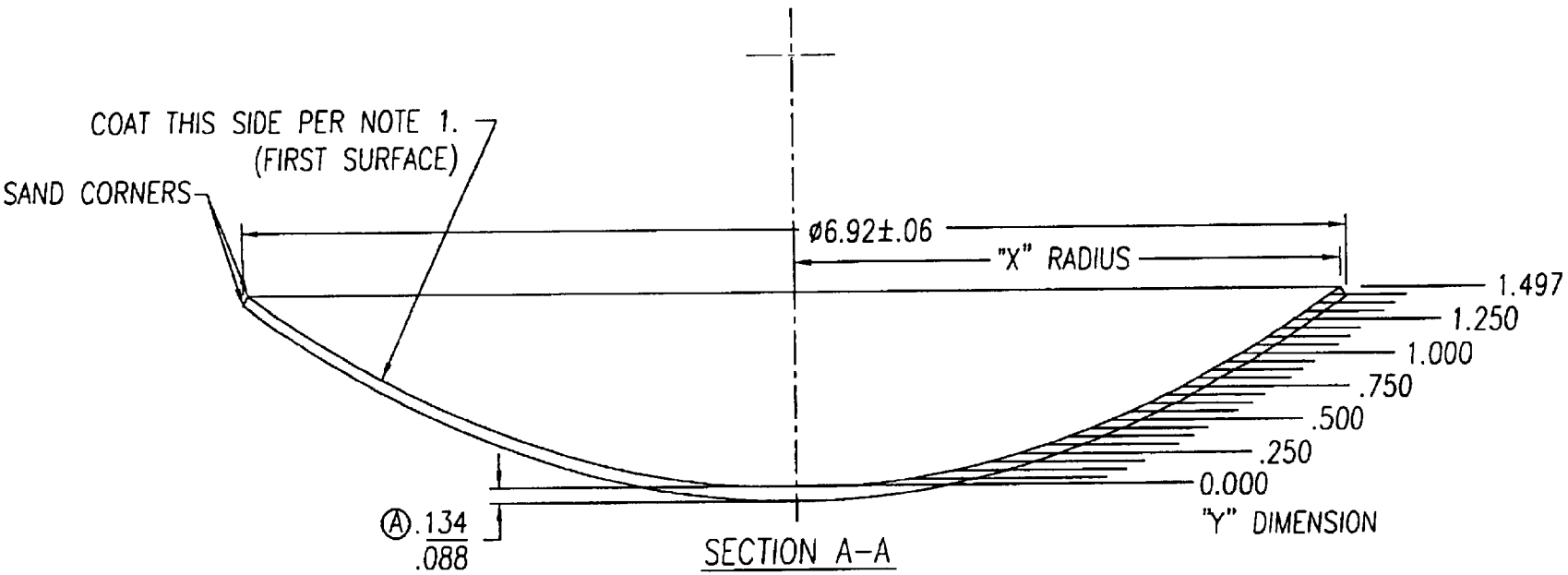
Figure 13F:
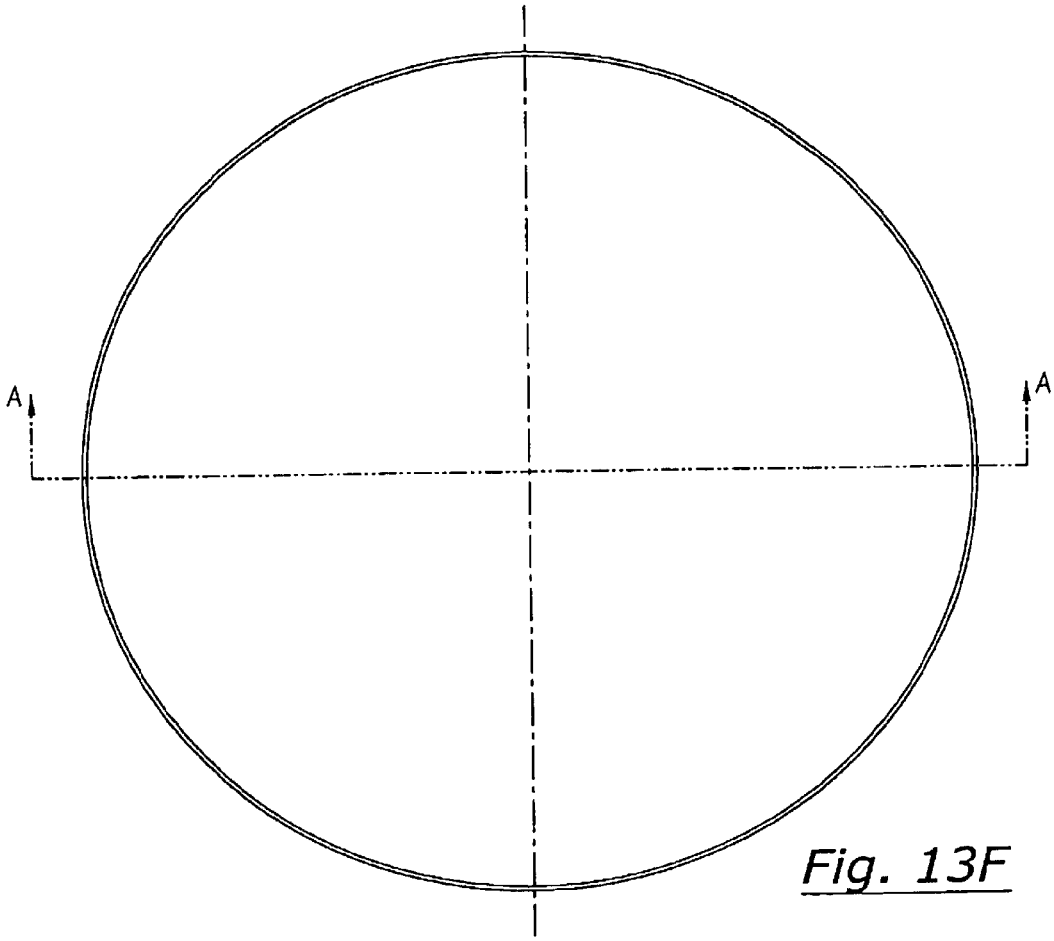
Figure 13H:
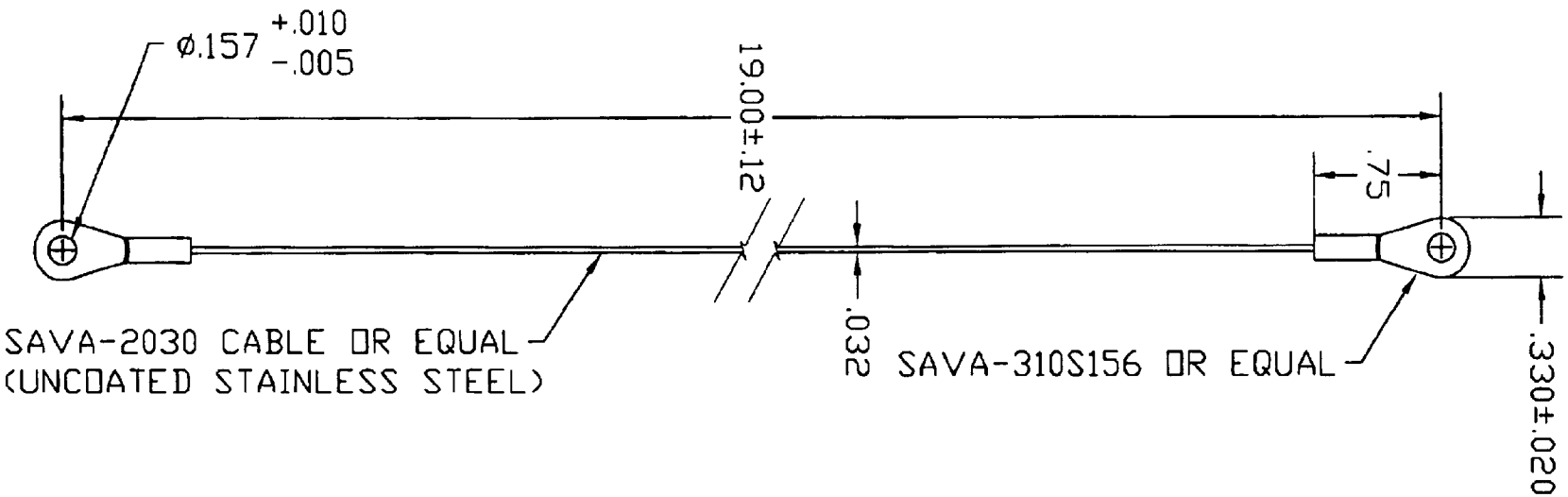

Further note spring clamps 106L and R at opposite lamp ends which cooperate with lamp holder assembly 22 to essentially allow lamp assembly 24 to be snapped in and out, quickly and easily and without tools (see particularly FIG. 5).

The specific structure of finger safe connections 104 are shown at FIGS. 3A, 4, 6A–C, 9A–D, 10A–E, and 11A–E. The nature of these "finger-safe" connections is that they do not expose electrically conducting surfaces that can contacted directly by human fingers. Thus, even if the connections are electrically live, they will not shock a human even if the human handles them with his/her hands. Further description of finger-safe connections is set forth in U.S. Ser. No. 09/076,278, owned by the owner of the present application, and incorporated by reference herein.

As can be seen in the Figures, particularly FIGS. 1, 2, 3A, and 9A–D, connector assembly 28 mounts (by screws, bolts, or other means) into the interior of cone 12. As shown, see particularly FIGS. 3A, 9A–D, and 11A–E, two finger-safe connections 304L and R (male—left and right) can be integrally formed in a block that can be screwed, bolted or otherwise fixed to a plate or base of assembly 28. Each finger-safe connection 304L and R is raised from the plate or base, is rectangular or square in cross-section, and has raised tabs basically centered on three or all of its sides, and have distal ends that point generally in parallel towards the opening in cone 12 to reflector 18. Electrical leads from an electrical power source enter the opposite ends of finger-safe connections 304L and R, are fixed therein, and have exposed conducting surfaces internally of finger-safe connections 304L and R.

FIGS. 3A, 4, 6A–C, and 10A–E illustrate in detail complementary mating finger-safe female connections 104L and R having proximal ends connected to electrical leads 102L and R to opposite ends of arc tube 100. Connections 104 are identical and each has a distal end that matingly slides over a corresponding distal end of a connection 304. Note that the distal ends of connections 104L and R have medial axial slots on two opposite sides that extend from distal-most open ends a distance inwardly and then stop, and have holes on the other two opposite sides. These slots and holes align with the raised tabs on the exterior surfaces of the sides of connections 304 such that when connections 104 are first brought over connections 304, the shape of the connections help guide them together, and then, the raised tabs of 304 enter and slide in the slots of 104 until the other raised tabs of 304 reach the holes in two sides of 104. Those raised tabs enter the holes and basically snap in place and lock connections 104 and 304 together, resisting axial seperation. Connections 104 have internally exposed, but finger-safe conduction surfaces that are configured to frictionally engage or contact exposed conducting surfaces internal of 304 to create an electrical connection through each mated set 104R/304L and 104R/304L.

Note also that guides or tunnels 306L and R are aligned with the longitudinal axes of 304L and R respectively, are fixed to the plate or base of assembly 28, and are configured to allow passage of a connection 104, but closely conforms to the exterior shape of connection 104. Thus, guides 306 force the distal ends of 104 to be aligned with the distal ends of 304 when they come into close proximity, to ensure 104 is correctly oriented for mating with 304. None of the surfaces or pieces have electrically conducting surfaces accessible to human fingers.

Note that connections 104 are quite elongated. This allows the proximal ends of 104 (those nearest to the opening between cone 12 and reflector 18), to be close to that opening for easier access and gripping by a worker, but also allows the actual electrical junction between connectors 104 and 304 to be farther away from that opening; and thus farther away from heat generated inside reflector 18 during operation of lamp 100, some of which is conducted to the exterior of reflector 18 and cone 12. This is beneficial to deter or reduce any effect of such significant heat on these connections.

FIGS. 7A–E and 8A–D illustrate in detail structure associated with lamp 100. In particular in the embodiment of FIG. 7A–E, lamp 100 can include a coating 110 all around lamp 100 that blocks and/or absorbs UV radiation generated in lamp 100. Such coatings are available from commercial entities. Coatings to block UV radiation are also disclosed in commonly owned U.S. Ser. No. 09/076,277, incorporated by reference herein. Such coatings do not allow any more UV radiation from lamp 100 than glass lenses do in conventional fixtures. They are also formulated to adhere to lamp 100 and remain for a useful life even in the high temperatures created by HID lamps. Additionally, lamp 100 could also have another coating 112 on or near a portion of its body. Here coating 112 is a reflective coating that, when lamp 100 is installed, is positioned on the outer facing side of lamp 100. It reflects or returns light that otherwise would travel directly out fixture 10 through lamp 100 and to reflectors 18 and/or 26. This light energy can then be collected and directed by those reflectors. Reflective coating 112 therefore can assist in diminishing glare that otherwise might be caused by light emanating directly out of fixture 10 without being controlled by any reflector, It is believed that use of UV coating 110 and/or reflective coating 112, and the resulting redirection of light energy back through lamp 100 may increase lamp life for lamp 100. It is believed that the reason is that there is a more uniform heating of the arc generated by the HID lamp.

Other details of lamp 100 in this embodiment are shown at FIGS. 7A–E. An automatic location structure (see e.g., detail A of FIG. 7) can be built in so that reflective coating 112 always ends up in the proper position.

One way to accomplish this is to utilize the spring clips 106L and R shown in detail in FIG. 5, for example. They are clamped to opposite ends of lamp 100 (other means or methods may be used to hold them in position once installed). FIGS. 4 and 6A–C show the clips in relation to arc tube 100, and in particular to the optional reflector 112. FIGS. 1–3A then shows in more detail receivers 134L and R at the distal ends of outwardly extending arms 132L and R connected to reinforcing ring, all of which forms lamp holder assembly 22. Receivers 134L and R are u-shaped and have holes on opposite sides of the u-shape aligned along a transverse axis. Clips 106 have shoulders on opposite sides configured to snap into place in holes in receivers 134L and R when lamp 100 is brought into place in holder assembly 22. Clips 106 fixed in a predetermined way to lamp 100 such that when the shoulders enter the holes in receivers 134L and R, the correct rotational position of lamp 100 is automatically assured. Thus, the worker that is installing or relamping the lighting fixture can do so without tools, and having rotational position of lamp 100, and for example reflector 18, automatic.

To remove lamp 100, simply, quickly and manually without tools, one simply grabs the outward extended ends of spring clips 106, and squeezes them together to release the shoulders of spring clips 106 from the holes in receivers 134L and R.

Lamp Holder Assembly

FIGS. 1, 2, 3A–B, and 12A–F detail lamp hoider assembly 22. Note particularly how lamp brackets 132 extend outwardly angularly from reinforcing ring (a part of lamp holder assembly 22) to receivers 134L and R, which have rectangular openings to receive the spring clamp and releasably seat lamp 100 in place. Wire clips 136 allow leads 102 to be removably secured along brackets 132.

Parabloid Assembly

FIGS. 1, 2, 3A–B and 13A–H detail an embodiment of parabloid reflector 200. Vertical and horizontal brackets 202 and 204 cooperate with clamps 206 to grasp reflector 200. This structure insulates this glass reflector from metal to reduce the potential for breakage. Ceramic blankets can be placed on the back of reflector 200 to help insulate the interior of cone 12 from heat. Also, a firewall 210 can be mounted as shown. Assembly 26 along with spring clips 208 (see FIG. 3A), allow reflector 200 to be quickly and easily installed and removed, without tools.

Fixture Connector Assembly

Lamp leads 102L and R are connectable and disconnectable to electrical power by releasable connection to the finger safe connectors 304L and R mounted on bracket 300 which in turn is mountable in the interior of cone 12 (see FIGS. 6A–C, 10A–E and 11A–E). Wires 302L and R are directed for connection to an electrical power source.

Note guide 306 that assists a worker to line up and insert finger-safe connections 104L and R into finger-safe connections 304L and R on bracket 300.

Miscellaneous

Figure 3A:
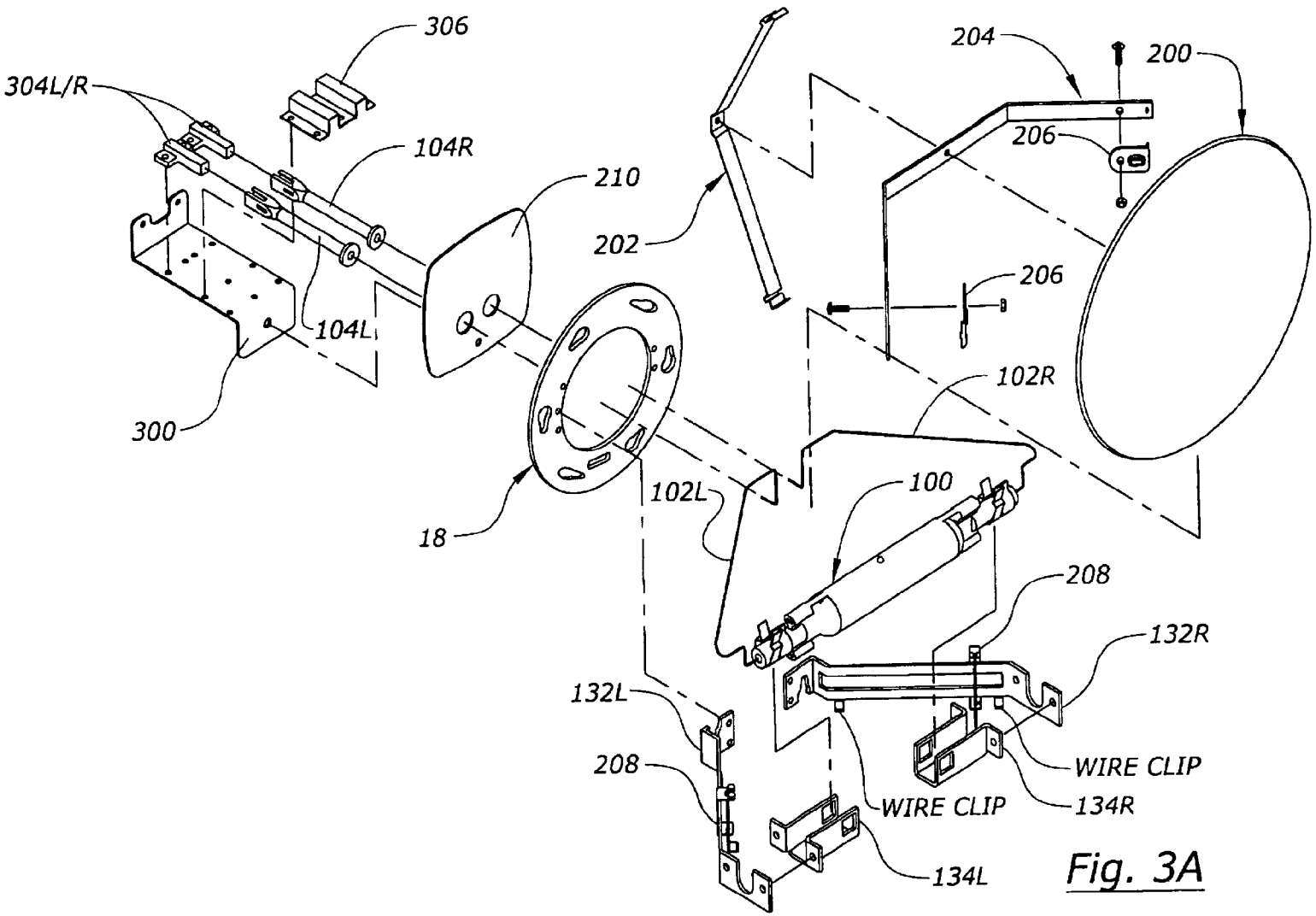
Figure 4:
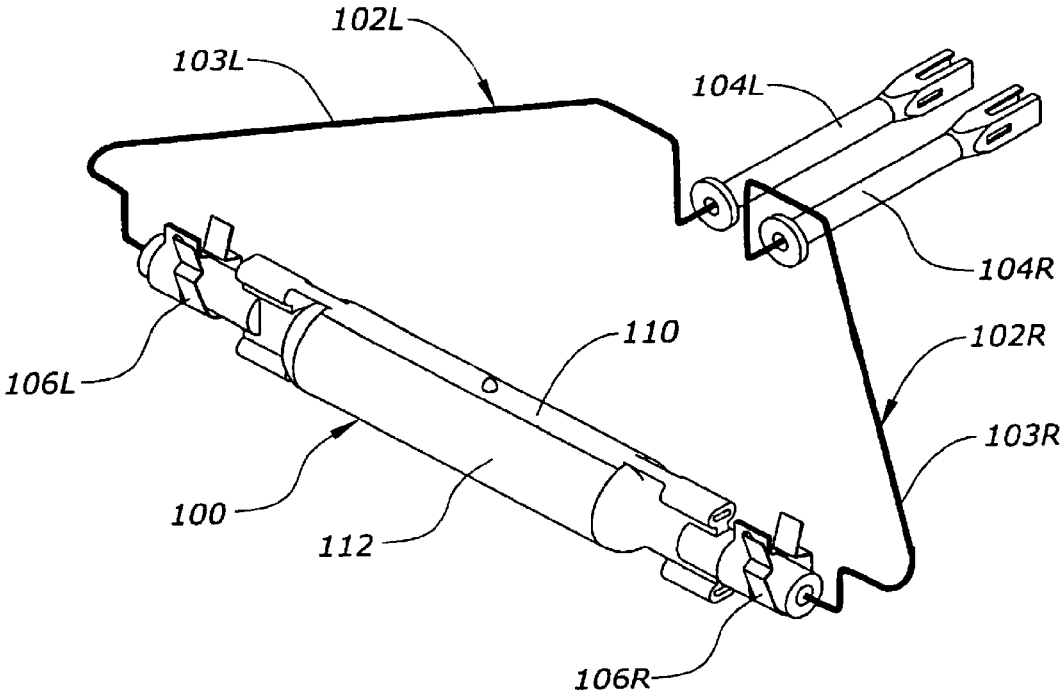
FIGS. 4, 5 and 6A–C are isometric views and details of the HID arc tube and electrical connector assembly of FIGS. 3A–B.

FIGS. 3A–B illustrate in exploded or isolated fashion certain of the parts discussed above.

Fixture or luminaire assembly 10 is assembled by installing connection assembly 28 into cone 12, and wiring electrical power leads to connections 304. Ignitor box 16 and its ignitor circuit are attached and connected electrically.

Lamp holder assembly 22 is mounted around the opening in the apex of reflector 18. Lamp 100 is snapped into assembly 22. Finger-safe connections 104 are manipulated into guides 306 and snapped over finger-safe connections 304. Parabolic reflector 26 is placed into position closing off the opening between reflector 18 and cone 12. Lens 20 is fixed in place by lens clips.

The assembly is finger-safe, even with power on, there is no UV threat because of the UV attenuation coating of lamp 100, the ignitor is in close proximity. Hooking up connections 104 and 304, installing parabolic reflector 26, mounting lamp 100 all are possible without tools and solely with a worker's hands.

Access to finger-safe connections 104L and R and 304L and R is just the reverse. The lens is opened. A cable (FIG. 13H) could be fixed between the lens and the reflector to prevent it from falling to the ground. Parabolic reflector 26 can be manually removed (a cable could also be connected between it and the fixture). The worker need only pull axially outward gently but with enough force to overcome the capture of the raised tabs of 304L and R in the openings of 104L and R, to separate finger-safe connections 104L and R and 304L and R and cut off electrical power to lamp 100.

This is efficient and economical and reliable. One can relamp quickly and easily.

It is noted that reflector 112 sends light that otherwise would leave lamp 100 back into lamp 100. It is believed that this might increase lamp life or lumen maintanence. It is believed that this promotes isothermal conditions in the arc tube 100.

Options and Alternatives

It is to be understood and appreciated that the above embodiment is given by way of example only, and not by way of limitation to the invention. The invention can take many forms and embodiments. Variations obvious to one skilled in the art will be included within the invention.

For example, the reflective coating 112 is not required. It can be used when desired. It could also be a separate piece held near lamp 100.

What is claimed is:

1. A luminaire assembly comprising:

a. a bulb cone includes an interior chamber in which is positioned a frame, the frame including a receiver adapted to fixedly hold a first finger-safe electrical connection and a guide adapted to guide a complementary second finger-safe connection into operative but manually releasable engagement with the second finger-safe connection;

b. a mounting connection adapted to mount the bulb cone to a support;

c. a reflector having a portion adapted for connection to the bulb cone and an opening adapted to be covered by a lens;

d. a mount for a double-ended unjacketed HID light source, the mount adapted to be positioned interiorly of the reflector and including a member adapted to removably receive and hold a double-ended HID light source; and e. an electrical power connection adapted for connection to a source of electrical power.

2. The luminaire assembly of claim 1 wherein the HID source is an arc tube having about 1000 watts or more rating.

3. The luminaire assembly of claim 1 further comprising a UV attenuation applied to the HID source.

4. The luminaire assembly of claim 3 wherein the UV attenuation substantially attenuates UV radiation from any part of the HID source.

5. The luminaire assembly of claim 1 where there is no exposed electrically conducting surface from the HID source to a connection to a source of electrical power when the electrical circuit is connected.

6. The luminaire assembly of claim 5 where there is no electrically conducting surface that can be accessed by human fingers when connections to electrical power at the luminaire assembly are disconnected.

7. A method of generating light from a luminaire assembly according to claim 1 having an HID light source comprising: positioning an HID light source in the form of an arc tube in a reflector; redirecting light from a portion of the HID light source that otherwise would leave the arc tube back towards a portion of the arc tube.

8. The method of claim 7 wherein the light is redirected in a manner to encourage uniform heating of the arc tube.

9. The luminaire assembly of claim 1 further comprising an ignitor circuit for the HID source, the ignitor circuit adapted to be segregated from a ballast circuit for the HID source, the ignitor circuit being closer to the HID source than to the ballast circuit.

10. The luminaire assembly of claim 9 further comprising a housing for the ignitor circuit adapted to be mounted on or adjacent to the luminaire assembly.

11. The luminaire assembly of claim 10 wherein the ignitor circuit housing is adapted to be mounted to the bulb cone of the luminaire assembly.

12. The apparatus of claim 2 further comprising another receiver and guide adapted for a second set of first and second finger-safe connections.

13. The apparatus of claim 2 wherein the second finger-safe connection has an elongated insulated body.

14. The apparatus of claim 2 wherein the first finger-safe connection is positioned in the interior of the bulb cone and the second finger-safe connection, when engaged with the first finger-safe connection, extends towards the reflector.

15. The apparatus of claim 14 further comprising a removable portion of the reflector at the portion attached to the bulb cone to gain access to the finger-safe connections.

16. The luminaire assembly of claim 1 wherein said mount for said HID source comprises first and second spaced apart receivers, one for each of said double ends of the HID source; each receiver connected to an arm extending to a portion adapted for mounting to either the reflector or the bulb cone, such that the receivers are positioned to hold an HID source in a desired position interiorly of the reflector.

17. The luminaire assembly of claim 16 further comprising manually releasably members on one of the receivers or the HID light source adapted to releasably lock the HID source into the receivers.

18. The luminaire assembly of claim 17 wherein the manually releasable members comprise resilient devices that engage and lock into complementary structure in the receivers.

19. The luminaire assembly of claim 18 wherein the manually releasable members comprise spring clips attached to ends of the HID source, the spring clips in a normal state being expanded in at least one direction, and having manually manipulatable portions allowing retraction in said at least one direction.

20. The luminaire assembly of claim 17 further comprising structure to orient said HID source in a desired rotation orientation relative to a longitudinal axis of an HID source when mounted.

21. The luminaire assembly of claim 20 further comprising a reflective member on a portion of an HID source, the reflective member positioned to redirect light energy from the source interiorly of the source.

22. A luminaire assembly comprising:

a. a bulb cone including an interior chamber in which is positioned a frame, the frame including a receiver adapted to fixedly hold a first finger-safe electrical connection and a guide adapted to guide a complementary second finger-safe connection into operative but manually releasable engagement with the second finger-safe connection;

b. a mounting connection adapted to mount the bulb cone to a support;

c. a reflector having a portion adapted for connection to the bulb cone and an opening adapted to be covered by a lens;

d. a mount for a double-ended unjacketed HID light source, the mount adapted to be positioned interiorly of the reflector and including a member adapted to removably receive and hold a double-ended HID light source; and e. an electrical power connection adapted for connection to a source of electrical power.

23. The apparatus of claim 22 further comprising another receiver and guide adapted for a second set of first and second finger-safe connections.

24. The apparatus of claim 22 wherein the second finger-safe connection has an elongated insulated body.

25. The luminaire assembly of claim 22 wherein the HID source is an arc tube having about 1000 watts or more rating.

26. The apparatus of claim 22 wherein the first finger-safe connection is positioned in the interior of the bulb cone and the second finger-safe connection, when engaged with the first finger-safe connection, extends towards the reflector.

27. The apparatus of claim 26 further comprising a removable portion of the reflector at the portion attached to the bulb cone to gain access to the finger-safe connections.

28. The luminaire assembly of claim 22 further comprising a UV attenuation applied to the HID source.

29. The luminaire assembly of claim 28 wherein the UV attenuation substantially attenuates UV radiation from any part of the HID source.

30. The luminaire assembly of claim 22 where there is no exposed electrically conducting surface from the HID source to a connection to a source of electrical power when the electrical circuit is connected.

31. The luminaire assembly of claim 30 where there is no electrically conducting surface that can be accessed by human fingers when connections to electrical power at the luminaire assembly are disconnected.

32. A method of generating light from a luminaire assembly according to claim 22 having an HID light source comprising: positioning an ID light source in the form of an arc tube in a reflector; redirecting light from a portion of the HID light source that otherwise would leave the arc tube back towards a portion of the arc tube.

33. The method of claim 32 wherein the light is redirected in a manner to encourage isothermal conditions in the arc tube.

34. The luminaire assembly of claim 22 further comprising an ignitor circuit for the HID source, the ignitor circuit adapted to be segregated from a ballast circuit for the HID source, the ignitor circuit being closer to the HID source than to the ballast circuit.

35. The luminaire assembly of claim 34 further comprising a housing for the ignitor circuit adapted to be mounted on or adjacent to the luminaire assembly.

36. The luminaire assembly of claim 35 wherein the ignitor circuit housing is adapted to be mounted to the bulb cone of the luminaire assembly.

37. The luminaire assembly of claim 22 wherein said mount for said HID source comprises first and second spaced apart receivers, one for each of said double ends of the HID source; each receiver connected to an arm extending to a portion adapted for mounting to either the reflector or the bulb cone, such that the receivers are positioned to hold an HID source in a desired position interiorly of the reflector.

38. The luminaire assembly of claim 37 further comprising manually releasably members on one of the receivers or the HID light source adapted to releasably lock the HID source into the receivers.

39. The luminaire assembly of claim 38 wherein the manually releasable members comprise resilient devices that engage and lock into complementary structure in the receivers.

40. The luminaire assembly of claim 39 wherein the manually releasable members comprise spring clips attached to ends of the HID source, the spring clips in a normal state being expanded in at least one direction, and having manually manipulatable portions allowing retraction in said at least one direction.

41. The luminaire assembly of claim 38 further comprising structure to orient said HID source in a desired rotation orientation relative to a longitudinal axis of an HID source when mounted.

42. The luminaire assembly of claim 41 further comprising a reflective member on a portion of an HID source, the reflective member positioned to redirect light energy from the source interiorly of the source.

43. A luminaire assembly comprising:

a. a bulb cone;

b. a mounting connection adapted to mount the bulb cone to a support;

c. a reflector having a portion adapted for connection to the bulb cone and an opening adapted to be covered by a lens;

d. a mount for a double-ended unjacketed HID light source, the mount adapted to be positioned interiorly of the reflector and including a member adapted to removably receive and hold a double-ended HID light source, said mount comprising first and second spaced apart receivers, one for each of said double ends of the HID light source; each receiver connected to an arm extending to a portion adapted for mounting to either the reflector or the bulb cone, such that the receivers are positioned to hold an HID light source in a desired position interiorly of the reflector, further comprising manually releasably members on one of the receivers or the HID light source adapted to releasably lock the HID light source into the receivers, the manually releasable members comprising resilient devices that engage and lock into complementary structure in the receivers, the manually releasable members comprising spring clips attached to ends of the HID light source, the spring clips in a normal state being expanded in at least one direction, and having manually manipulatable portions allowing retraction in said at least one direction; and e. an electrical power connection adapted for connection to a source of electrical power.

44. The apparatus of claim 43 wherein the second finger-safe connection has an elongated insulated body.

45. The luminaire assembly of claim 43 wherein the HID source is an arc tube having about 1000 watts or more rating.

46. The luminaire assembly of claim 43 wherein the bulb cone includes an interior chamber in which is positioned a frame, the frame including a receiver adapted to fixedly hold a first finger-safe electrical connection and a guide adapted to guide a complementary second finger-safe connection into operative but manually releasable engagement with the second finger-safe connection.

47. The apparatus of claim 46 further comprising another receiver and guide adapted for a second set of first and second finger-safe connections.

48. The apparatus of claim 46 wherein the first finger-safe connection is positioned in the interior of the bulb cone and the second finger-safe connection, when engaged with the first finger-safe connection, extends towards the reflector.

49. The apparatus of claim 48 further comprising a removable portion of the reflector at the portion attached to the bulb cone to gain access to the finger-safe connections.

50. The luminaire assembly of claim 43 further comprising structure to orient said HID source in a desired rotation orientation relative to a longitudinal axis of an HID source when mounted.

51. The luminaire assembly of claim 50 further comprising a reflective member on a portion of an HID source, the reflective member positioned to redirect light energy from the source interiorly of the source.

52. The luminaire assembly of claim 43 further comprising a UV attenuation applied to the HID source.

53. The luminaire assembly of claim 52 wherein the UV attenuation substantially attenuates UV radiation from any part of the HID source.

54. The luminaire assembly of claim 43 where there is no exposed electrically conducting surface from the HID source to a connection to a source of electrical power when the electrical circuit is connected.

55. The luminaire assembly of claim 54 where there is no electrically conducting surface that can be accessed by human fingers when connections to electrical power at the luminaire assembly are disconnected.

56. A method of generating light from a luminaire assembly according to claim 43 having an HID light source comprising: positioning an HID light source in the form of an arc tube in a reflector; redirecting light from a portion of the HID light source that otherwise would leave the arc tube back towards a portion of the arc tube.

57. The method of claim 56 wherein the light is redirected in a manner to encourage isothermal conditions in the arc tube.

58. The luminaire assembly of claim 43 further comprising an ignitor circuit for the HID source, the ignitor circuit adapted to be segregated from a ballast circuit for the HID source, the ignitor circuit being closer to the HID source than to the ballast circuit.

59. The luminaire assembly of claim 58 further comprising a housing for the ignitor circuit adapted to be mounted on or adjacent to the luminaire assembly.

60. The luminaire assembly of claim 59 wherein the ignitor circuit housing is adapted to be mounted to the bulb cone of the luminaire assembly.

61. A luminaire assembly, comprising:

a. a bulb cone includes an interior chamber in which is positioned a frame, the frame including a receiver adapted to fixedly hold a first finger-safe electrical connection and a guide adapted to guide a complementary second finger-safe connection into operative but manually releasable engagement with the second finger-safe connection;

b. a mounting connection adapted to mount the bulb cone to a support;

c. a reflector having a portion adapted for connection to the bulb cone and an opening adapted to be covered by a lens;

d. a mount for a double-ended unjacketed HID light source, the mount adapted to be positioned interiorly of the reflector and including a member adapted to removably receive and hold a double-ended HID light source;

e. an electrical power connection adapted for connection to a source of electrical power;

f. said mount for said HID source comprises first and second spaced apart receivers, one for each of said double ends of the HID source; each receiver connected to an arm extending to a portion adapted for mounting to either the reflector or the bulb cone, such that the receivers are positioned to hold an HID source in a desired position interiorly of the reflector;

g. further comprising manually releasably members on one of the receivers or the HID light source adapted to releasably lock the HID source into the receivers;

h. wherein the manually releasable members comprise resilient devices that engage and lock into complementary structure in the receivers; and i. wherein the manually releasable members comprise spring clips attached to ends of the HID source, the spring clips in a normal state being expanded in at least one direction, and having manually manipulatable portions allowing retraction in said at least one direction.

62. The luminaire assembly of claim 61 further comprising another receiver and guide adapted for a second set of first and second finger-safe connections.

63. The luminaire assembly of claim 61 wherein the second finger-safe connection has an elongated insulated body.

64. The luminaire assembly of claim 61 further comprising structure to orient said HID source in a desired rotation orientation relative to a longitudinal axis of an HID source when mounted.

65. The luminaire assembly of claim 61 further comprising a reflective member on a portion of an HID source, the reflective member positioned to redirect light energy from the source interiorly of the source.

66. The luminaire assembly of claim 61 further comprising an ignitor circuit for the HID source, the ignitor circuit adapted to be segregated from a ballast circuit for the HID source, the ignitor circuit being closer to the HID source than to the ballast circuit.

67. The luminaire assembly of claim 61 further comprising a housing for the ignitor circuit adapted to be mounted on or adjacent to the luminaire assembly.

68. The luminaire assembly of claim 61 wherein the ignitor circuit housing is adapted to be mounted to the bulb cone of the luminaire assembly.

69. The luminaire assembly of claim 61 further comprising a UV attenuation applied to the HID source.

70. The luminaire assembly of claim 61 wherein the UV attenuation substantially attenuates UV radiation from any part of the HID source.

71. The luminaire assembly of claim 61 wherein the HID source is an arc tube having about 1000 watts or more rating.

72. The luminaire assembly of claim 61 where there is no exposed electrically conducting surface from the HID source to a connection to a source of electrical power when the electrical circuit is connected.

73. The luminaire assembly of claim 61 where there is no electrically conducting surface that can be accessed by human fingers when connections to electrical power at the luminaire assembly are disconnected.

74. The luminaire assembly of claim 61 wherein the first finger-safe connection is positioned in the interior of the bulb cone and the second finger-safe connection, when engaged with the first finger-safe connection, extends towards the reflector.

75. The luminaire assembly of claim 74 further comprising a removable portion of the reflector at the portion attached to the bulb cone to gain access to the finger-safe connections.

76. A method of generating light from a luminaire assembly according to claim 61 having an HID light source comprising: positioning an HID light source in the form of an arc tube in a reflector; redirecting light from a portion of the HID light source that otherwise would leave the arc tube back towards a portion of the arc tube.

77. The method of claim 76 wherein the light is redirected in a manner to encourage uniform heating of the arc tube.

* * * * *

UNITED STATES PATENT AND TRADEMARK OFFICE

CERTIFICATE OF CORRECTION

PATENT NO. : 7,059,745 B2
APPLICATION NO. : 10/072703
DATED : June 13, 2006
INVENTOR(S) : Myron K. Gordin and Timothy J. Boyle It is certified that error appears in the above-identified patent and that said Letters Patent is hereby corrected as shown below:

Claim 32, Column 10, line 5:
change "ID" to --HID--.

Signed and Sealed this

Fifth Day of September, 2006

JON W. DUDAS
*Director of the United States Patent and Trademark Office*